US009046866B2

(12) United States Patent
Sato et al.

(10) Patent No.: US 9,046,866 B2
(45) Date of Patent: Jun. 2, 2015

(54) CLEANING DEVICE AND IMAGE FORMING APPARATUS

(71) Applicant: FUJI XEROX CO., LTD., Minato-ku, Tokyo (JP)

(72) Inventors: Koichi Sato, Kanagawa (JP); Kazuyoshi Hagiwara, Kanagawa (JP); Kazutoshi Sugitani, Kanagawa (JP); Kuniaki Tanaka, Kanagawa (JP); Yuji Kamikawa, Kanagawa (JP); Koji Deguchi, Kanagawa (JP); Yusuke Sakai, Kanagawa (JP); Kaoru Matsushita, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 133 days.

(21) Appl. No.: 13/744,817

(22) Filed: Jan. 18, 2013

(65) Prior Publication Data

US 2014/0056609 A1 Feb. 27, 2014

(30) Foreign Application Priority Data

Aug. 23, 2012 (JP) ..... 2012-183769

(51) Int. Cl.
*G03G 15/16* (2006.01)
*G03G 21/00* (2006.01)

(52) U.S. Cl.
CPC ..... *G03G 21/0076* (2013.01)

(58) Field of Classification Search
CPC ..... G03G 21/0076
USPC ..... 399/101, 123, 349
See application file for complete search history.

(56) References Cited

U.S. PATENT DOCUMENTS

| | | | | |
|---|---|---|---|---|
| 6,112,046 | A * | 8/2000 | Suzuki et al. | 399/359 |
| 2002/0076227 | A1* | 6/2002 | De Jong et al. | 399/66 |
| 2007/0065195 | A1* | 3/2007 | Bateman et al. | 399/349 |
| 2007/0230994 | A1 | 10/2007 | Takishita | |
| 2008/0304856 | A1* | 12/2008 | Takahashi | 399/101 |
| 2012/0008973 | A1* | 1/2012 | Sakakibara et al. | 399/71 |
| 2013/0142540 | A1* | 6/2013 | Kaneko et al. | 399/101 |

FOREIGN PATENT DOCUMENTS

| | | | |
|---|---|---|---|
| JP | 2007-279121 | A | 10/2007 |
| JP | 2008-076858 | A | 4/2008 |

* cited by examiner

*Primary Examiner* — David Gray
*Assistant Examiner* — Thomas Giampaolo, II
(74) *Attorney, Agent, or Firm* — Sughrue Mion, PLLC

(57) ABSTRACT

A cleaning device includes first and second cleaning members and a moving member. The first cleaning member contacts a surface of a rotating member, which is in contact with an image carrier, to clean the rotating member by removing substances attached thereto. The moving member supports the first cleaning member in a movable manner. The second cleaning member is disposed downstream of the first cleaning member in a rotation direction in which the rotating member rotates and contacts the surface of the rotating member to clean the rotating member by removing the substances. The second cleaning member removes the substances that remain on the surface of the rotating member after the first cleaning member has been separated from the rotating member so that the substances are removed before a part of the surface of the rotating member on which the substances remain comes into contact with the image carrier.

9 Claims, 16 Drawing Sheets

CLEANING DEVICE AND IMAGE FORMING APPARATUS

CROSS-REFERENCE TO RELATED APPLICATIONS

This application is based on and claims priority under 35 USC 119 from Japanese Patent Application No. 2012-183769 filed Aug. 23, 2012.

BACKGROUND

Technical Field

The present invention relates to a cleaning device and an image forming apparatus.

SUMMARY

According to an aspect of the invention, there is provided a cleaning device including a first cleaning member, a moving member, and a second cleaning member. The first cleaning member contacts a surface of a rotating member to clean the rotating member by removing substances attached to the rotating member, the rotating member being disposed in contact with an image carrier that carries an image on a surface thereof. The moving member supports the first cleaning member such that the first cleaning member is movable toward and away from the surface of the rotating member. The second cleaning member is disposed downstream of the first cleaning member in a rotation direction in which the rotating member rotates and contacts the surface of the rotating member to clean the rotating member by removing the substances attached to the rotating member. The second cleaning member removes the attached substances that remain on the surface of the rotating member after the first cleaning member has been separated from the rotating member so that the attached substances are removed before a part of the surface of the rotating member on which the attached substances remain comes into contact with the image carrier.

BRIEF DESCRIPTION OF THE DRAWINGS

Exemplary embodiments of the present invention will be described in detail based on the following figures, wherein:

FIGS. 3A and 3B are diagrams for explaining a movement of a first cleaning member according to the first exemplary embodiment, wherein FIG. 3A illustrates a state in which the first cleaning member has been moved to a position where the first cleaning member is in contact with a rotating member and FIG. 3B illustrates a state in which the first cleaning member has been moved to a position separate from the rotating member;

FIGS. 7A and 7B are diagrams for explaining a problem that occurs when a scraper is separated from a transport belt, wherein FIG. 7A illustrates a state in which the scraper is in contact with the transport belt and FIG. 7B illustrates a state in which the scraper is separated from the transport belt;

FIGS. 8A to 8D are diagrams for explaining the operation of a cleaner according to the first exemplary embodiment, wherein FIG. 8A illustrates a state in which an image is being formed, FIG. 8B illustrates a state in which the scraper is in contact with the transport belt, FIG. 8C illustrates a state in which the scraper is separated from the transport belt and a toner aggregate has started to move downstream, and FIG. 8D illustrates a state in which the toner aggregate has been removed;

FIGS. 12A to 12E are diagrams for explaining the operation of the cleaner according to the second exemplary embodiment, wherein FIG. 12A illustrates a state in which an image is being formed, FIG. 12B illustrates a state in which the scraper is in a standby state after an operation of cleaning the transport belt has been started, FIG. 12C illustrates a state in which the scraper is in contact with the transport belt, FIG. 12D illustrates a state in which the scraper is separated from the transport belt and a toner aggregate has started to move downstream, and FIG. 12E illustrates a state in which the toner aggregate has been removed;

FIGS. 13A and 13B are diagrams for explaining a cleaner according to a third exemplary embodiment of the present invention, wherein FIG. 13A illustrates a state in which the transport belt is in contact with an intermediate transfer belt and FIG. 13B illustrates a state in which the transport belt is separated from the intermediate transfer belt;

FIGS. 16A to 16E are diagrams for explaining the operation of the cleaner according to the third exemplary embodiment, wherein FIG. 16A illustrates a state in which an image is being formed, FIG. 16B illustrates a state in which the scraper is in contact with the transport belt and the transport belt is separated from the intermediate transfer belt, FIG. 16C illustrates a state in which the scraper is separated from the transport belt and a toner aggregate has started to move downstream, FIG. 16D illustrates a state in which the toner aggregate has been removed, and FIG. 16E illustrates a state in which the transport belt is in contact with the intermediate transfer belt.

DETAILED DESCRIPTION

Exemplary embodiments of the present invention will be described with reference to the drawings. However, the present invention is not limited to the following exemplary embodiments.

To facilitate understanding of the following descriptions, the front-back direction, the left-right direction, and the up-down direction are defined as the X-axis direction, the Y-axis direction, and the Z-axis direction, respectively, in each figure. In addition, directions shown by arrows X, −X, Y, −Y, Z, and −Z are defined as forward, backward, rightward, leftward, upward, and downward, respectively, and sides in those directions are defined as the front side, the back side, the right side, the left side, the top side, and the bottom side, respectively.

In the figures, circles having dots at the center show the direction from back to front with respect to the sides illustrated in the figures, and circles having the "x" marks therein show the direction from front to back with respect to the sides illustrated in the figures.

In each figure, components other than those necessary for the explanations are omitted to facilitate understanding.

First Exemplary Embodiment

Overall Structure of Printer U of First Exemplary Embodiment

Figure 1:
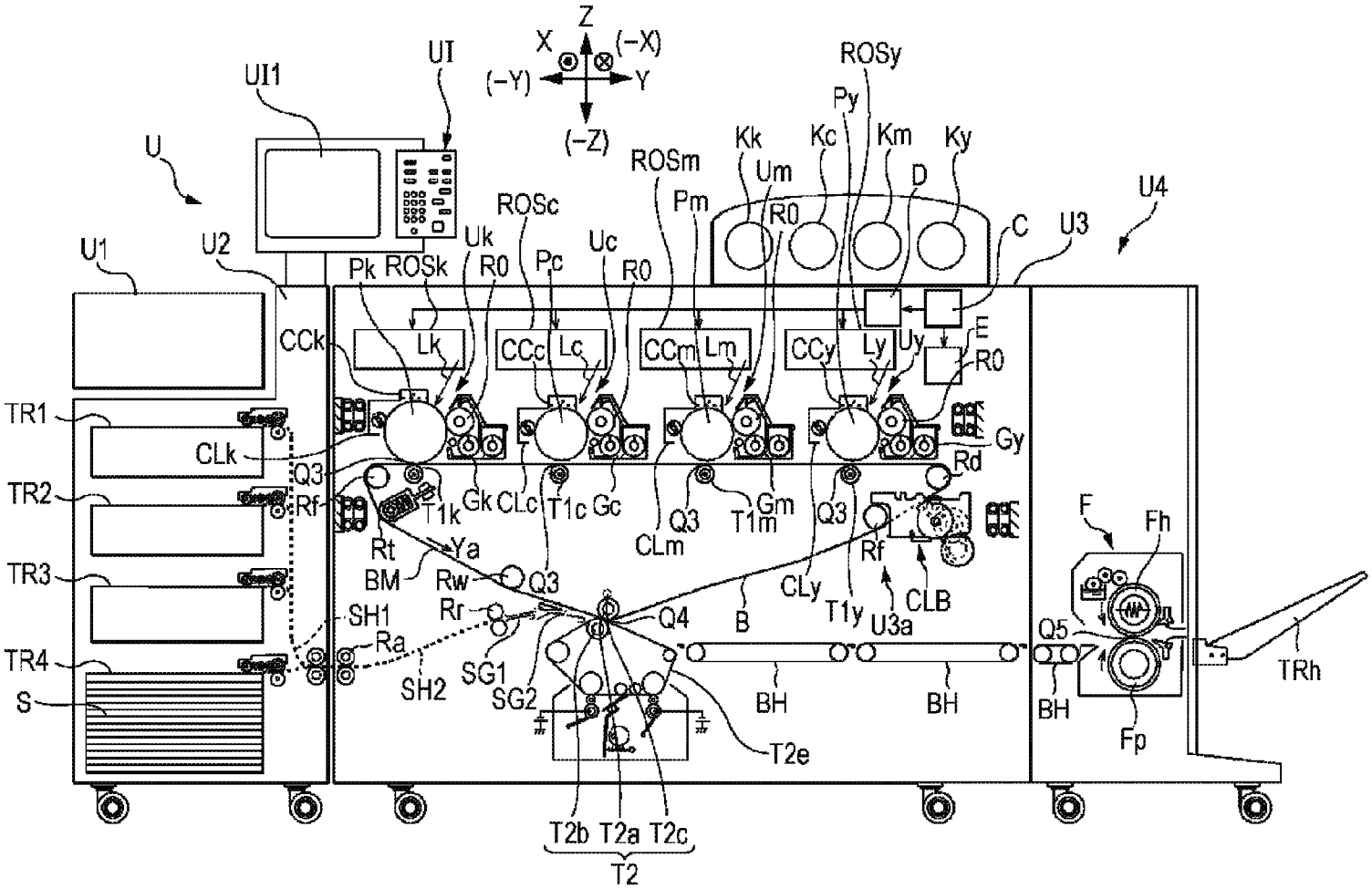
FIG. 1 is an overall view of an image forming apparatus according to a first exemplary embodiment of the present invention.

FIG. 1 is an overall view of an image forming apparatus according to a first exemplary embodiment of the present invention.

Referring to FIG. 1, a printer U, which is an example of an image forming apparatus according to the first exemplary embodiment, includes a scanner unit U1 as an example of an image reading section, a feeder unit U2 as an example of a feeding device that feeds a medium on which an image is to be recorded, a printer body U3, an output unit U4 as an example of an output device to which the medium on which the image has been recorded is output, and an operation unit UI that is operated by a user.

Structure of Marking Unit of First Exemplary Embodiment

Referring to FIG. 1, the printer body U3 includes a controller C that controls the image forming apparatus U, a communication unit (not shown) that receives image information read by the scanner unit U1, and a marking unit U3*a* as an example of an image recording unit that records an image on a medium.

The marking unit U3*a* includes photoconductors Py, Pm, Pc, and Pk as an example of image carriers for carrying yellow (Y), magenta (M), cyan (C), and black (K) images. The photoconductors Py to Pk have photosensitive dielectric surfaces.

Referring to FIG. 1, a charging unit CCk, an exposure unit ROSk, which is an example of a latent-image forming device, a developing unit Gk, a first transfer roller T1*k*, which is an example of a first transfer unit, and a photoconductor cleaner CLk, which is an example of an image-carrier cleaning device, are arranged around the photoconductor Pk for black in a rotation direction of the photoconductor Pk.

Similarly, charging units CCy, CCm, and CCc, exposure units ROSy, ROSm, and ROSc, developing units Gy, Gm, and Gc, first transfer rollers T1*y*, T1*m*, and T1*c*, and photoconductor cleaners CLy, CLm, and CLc are arranged around the other photoconductors Py, Pm, and Pc.

Toner cartridges Ky, Kc, Km, and Kk, which are an example of containers, are detachably supported on the marking unit U3*a*. The toner cartridges Ky to Kk contain developers to be supplied to the developing units Gy to Gk, respectively.

An intermediate transfer belt B, which is an example of an intermediate transfer body or an image carrier, is disposed below the photoconductors Py to Pk. The intermediate transfer belt B is disposed between the photoconductors Py to Pk and the first transfer rollers T1*y* to T1*k*. The back surface of the intermediate transfer belt B is supported by a drive roller Rd, which is an example of a driving member, a tension roller Rt, which is an example of a tension applying member, a walking roller Rw, which is an example of a meander prevention member, plural idler rollers Rf which are an example of driven members, a backup roller T2*a*, which is an example of a second transfer opposing member, plural retractable rollers which are an example of movable members, and the above-described first transfer rollers T1*y* to T1*k*.

A belt cleaner CLB, which is an example of an intermediate-transfer-body cleaning device, is disposed near the drive roller Rd on the front surface of the intermediate transfer belt B.

A second transfer roller T2*b*, which is an example of a second transfer member, is disposed so as to face the backup roller T2*a* with the intermediate transfer belt B interposed therebetween. A contact roller T2*c*, which is an example of a contact member, is in contact with the backup roller T2*a* so as to apply a voltage having a polarity opposite to the charge polarity of the developers to the backup roller T2*a*. In the first exemplary embodiment, a transport belt T2*e*, which is an example of a transport member, is wound around the second transfer roller T2*b*.

The backup roller T2*a*, the second transfer roller T2*b*, and the contact roller T2*c* constitute a second transfer unit T2 according to the first exemplary embodiment. The first transfer rollers T1*y* to T1*k*, the intermediate transfer belt B, and the second transfer unit T2 constitute a transfer device T1+B+T2 according to the first exemplary embodiment.

The feeder unit U2 includes paper feed trays TR1 to TR4, which are an example of containers that contain recording sheets S, which are an example of media. A paper feed path SH1, which is an example of a transport path, is provided so as to extend from each of the paper feed trays TR1 to TR4 toward the printer body U3. Transport rollers Ra, which are an example of transport members that transport the recording sheets S downstream, are arranged along the paper feed path SH1. A transport path SH2 is formed in a lower left area of the printer body U3. The transport path SH2 is connected to the paper feed path SH1.

A registration roller Rr, which is an example of an adjusting member that adjusts the time for transporting each recording sheet S toward the second transfer unit T2, is provided on the transport path SH2. Guides SG1 and SG2, which are an example of medium guide members, are disposed between the registration roller Rr and the second transfer roller T2*b*.

Plural transport belts BH that support each recording sheet S on the surfaces thereof and transport the recording sheet S downstream are disposed downstream of the transport belt T2*e* in the transport direction of the recording sheet S.

A fixing device F is disposed downstream of the transport belts BH in the transport direction of the recording sheet S. The fixing device F includes a heating roller Fh, which is an example of a heating member, and a pressing roller Fp, which is an example of a pressing member. A heater (not shown), which is an example of a heat source, is disposed in the heating roller Fh.

An output tray TRh, which is an example of an output unit, is supported at a position downstream of the fixing device F.

Operation of Marking Unit

When the image forming apparatus U receives image information transmitted from a personal computer via a print image server, a job, which is an image forming operation, is started. When the job is started, the photoconductors Py to Pk and the intermediate transfer belt B start to rotate.

The photoconductors Py to Pk are rotated by a drive source (not shown).

The charging units CCy to CCk receive a predetermined voltage to charge the surfaces of the photoconductors Py to Pk.

The exposure units ROSy to ROSk respectively output laser beams Ly, Lm, Lc, and Lk, which are an example of latent-image writing light, in accordance with control signals from the controller C, thereby writing electrostatic latent images on the charged surfaces of the photoconductors Py to Pk.

The developing units Gy to Gk develop the electrostatic latent images on the surfaces of the photoconductors Py to Pk into visible images.

The toner cartridges Ky to Kk supply the developers to the developing units Gy to Gk, respectively, as the developers are consumed in the developing process performed by the developing units Gy to Gk.

A first transfer voltage that has a polarity opposite to the charge polarity of the developers is applied to the first transfer rollers T1*y* to T1*k*, so that the visible images on the surfaces of the photoconductors Py to Pk are transferred onto the surface of the intermediate transfer belt B.

The photoconductor cleaners CLy to CLk clean the surfaces of the photoconductors Py to Pk by removing the developers that remain on the surfaces after the first transfer process.

When the intermediate transfer belt B passes through first transfer regions Q3 in which the intermediate transfer belt B faces the photoconductors Py to Pk, Y, M, C, and K images are transferred onto the intermediate transfer belt B in that order in a superposed manner. Subsequently, the intermediate transfer belt B passes through a second transfer region Q4 in which the intermediate transfer belt B faces the second transfer unit T2. When a monochrome image is to be formed, an image of a single color is transferred onto the intermediate transfer belt B and is transported to the second transfer region Q4.

The recording sheets S, which are an example of media, are contained in the paper feed trays TR1 to TR4. The recording sheets S contained in the paper feed trays TR1 to TR4 are fed in accordance with, for example, the size of the image information, designation of the recording sheets S, and the sizes and types of the recording sheets S contained in the paper feed trays TR1 to TR4. The transport rollers Ra transport each recording sheet S toward the registration roller Rr.

The registration roller Rr feeds the recording sheet S in accordance with a time at which the image on the surface of the intermediate transfer belt B is transported to the second transfer region Q4.

In the second transfer unit T2, a predetermined second transfer voltage that has the same polarity as the charge polarity of the developers is applied to the backup roller T2*a* via the contact roller T2*c*, so that the image on the intermediate transfer belt B is transferred onto the recording sheet S.

The belt cleaner CLB cleans the surface of the intermediate transfer belt B by removing the developers that remain on the surface after the image transfer process performed in the second transfer region Q4.

After the image is transferred onto the recording sheet S by the second transfer unit T2, the transport belts T2*e* and HB transport the recording sheet S downstream while supporting the recording sheet S on the surfaces thereof.

The fixing device F presses and heats the recording sheet S that passes through a region in which the heating roller Fh and the pressing roller Fp are in contact with each other, and thereby fixes the unfixed image on the surface of the recording sheet S.

The recording sheet S to which the image has been fixed by the fixing device F is output to the output tray TRh. The recording sheet S is stacked on the output tray TRh.

Second Transfer Unit of First Exemplary Embodiment

Figure 2:
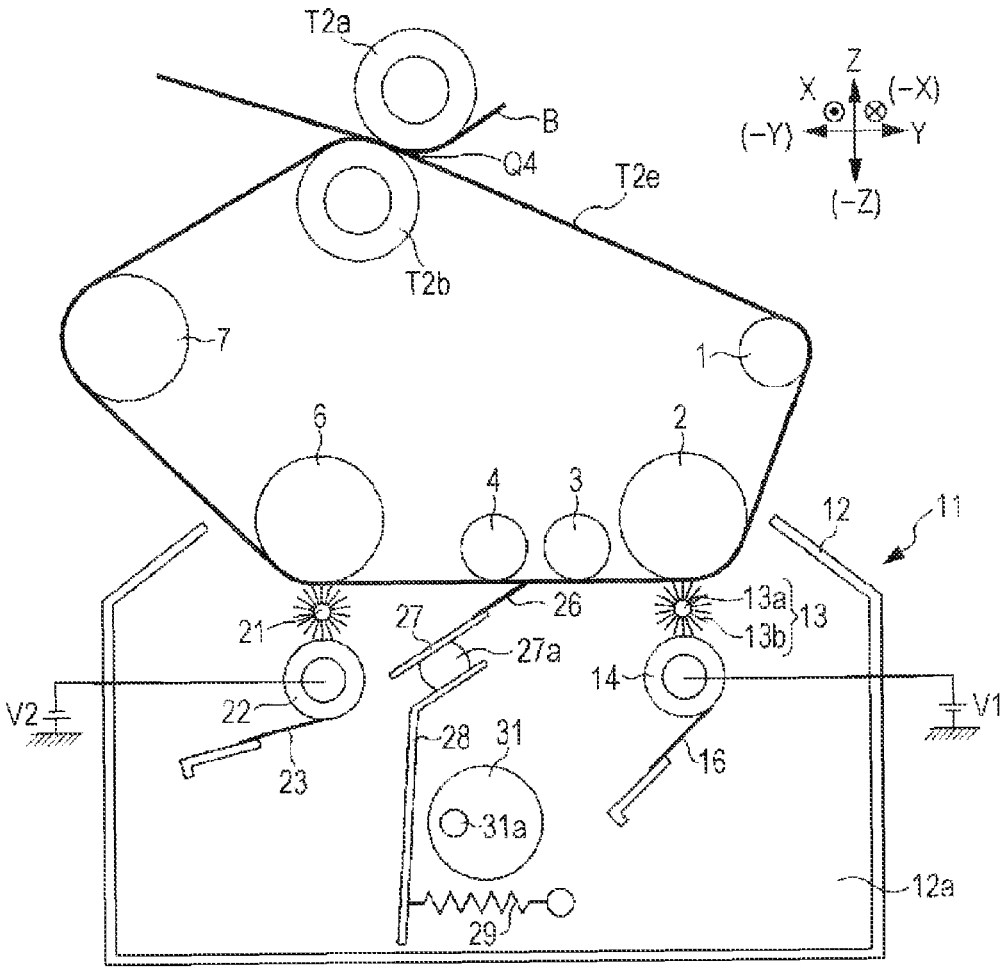
FIG. 2 illustrates a part of a second transfer unit according to the first exemplary embodiment.

FIG. 2 illustrates a part of the second transfer unit T2 according to the first exemplary embodiment.

Referring to FIGS. 1 and 2, the second transfer unit T2 according to the first exemplary embodiment includes a drive roller 1, which is an example of a driving member, in a lower right area thereof. The drive roller 1 is on the downstream side of the second transfer roller T2*b* in the transport direction of the recording sheet S and in the rotation direction of the transport belt T2*e*.

A first driven roller 2, which is an example of a driven member, is disposed downstream of the drive roller 1 in the rotation direction of the transport belt T2*e*. A first opposing roller 3, which is an example of a cleaning opposing member, is disposed downstream of the first driven roller 2 in the rotation direction of the transport belt T2*e*. A second opposing roller 4, which is also an example of a cleaning opposing member, is disposed downstream of the first opposing roller 3 in the rotation direction of the transport belt T2*e*. A second driven roller 6, which is an example of a driven member, is disposed downstream of the second opposing roller 4 in the rotation direction of the transport belt T2*e*. A tension roller 7, which is an example of a tension applying member, is disposed downstream of the second driven roller 6 in the rotation direction of the transport belt T2*e*.

Thus, the transport belt T2*e*, which is an example of a rotating member, is rotatably supported by the second transfer roller T2*b*, the drive roller 1, the driven rollers 2 and 6, the opposing rollers 3 and 4, and the tension roller 7.

A cleaner 11, which is an example of a cleaning device, is disposed below the driven rollers 2 and 6 and the opposing rollers 3 and 4. The cleaner 11 includes a casing 12 as an example of a container. A receiving chamber 12*a*, which receives attached substances that have been collected, is provided in the casing 12.

An upstream brush roller 13, which is an example of a third cleaning member, is supported in the receiving chamber 12*a* at a position where the upstream brush roller 13 faces the first driven roller 2 with the transport belt T2*e* interposed therebetween. The upstream brush roller 13 is a cylindrical brush-shaped member including a rotating shaft 13*a* and bristles 13*b* provided on the outer periphery of the rotating shaft 13*a*.

An upstream cleaning roller 14, which is an example of an attached-substance transferring member, is disposed below the upstream brush roller 13. The upstream cleaning roller 14 is arranged to be in contact with the upstream brush roller 13. The upstream cleaning roller 14 is made of a conductive material. A first voltage V1 is applied to the upstream cleaning roller 14. In the first exemplary embodiment, the first voltage V1 is a positive voltage having a positive polarity that differs from the charge polarity of the developers. The upstream brush roller 13 and the upstream cleaning roller 14 according to the first exemplary embodiment receive driving power from a motor (not shown) which is an example of a drive source.

An upstream scraper 16, which is an example of an attached-substance removing member, is disposed below the upstream cleaning roller 14. The upstream scraper 16 is a thin plate-shaped metal member that extends in the front-back direction. The upstream scraper 16 is supported such that an end portion thereof is in contact with a surface of the upstream cleaning roller 14.

A downstream brush roller 21, which is an example of a second cleaning member, is supported at a position where the downstream brush roller 21 faces the second driven roller 6 with the transport belt T2*e* interposed therebetween. The downstream brush roller 21 has a structure similar to that of the upstream brush roller 13. A downstream cleaning roller 22, which has a structure similar to that of the upstream cleaning roller 14, is supported so as to be in contact with the downstream brush roller 21. A negative voltage having a negative polarity that is opposite to the polarity of the first voltage V1 is applied to the downstream cleaning roller 22. Similar to the upstream brush roller 13 and the upstream cleaning roller 14, the downstream brush roller 21 and the downstream cleaning roller 22 receive driving power from the motor (not shown).

A downstream scraper 23, which has a structure similar to that of the upstream scraper 16, is supported so as to be in contact with the downstream cleaning roller 22.

Figure 3B:
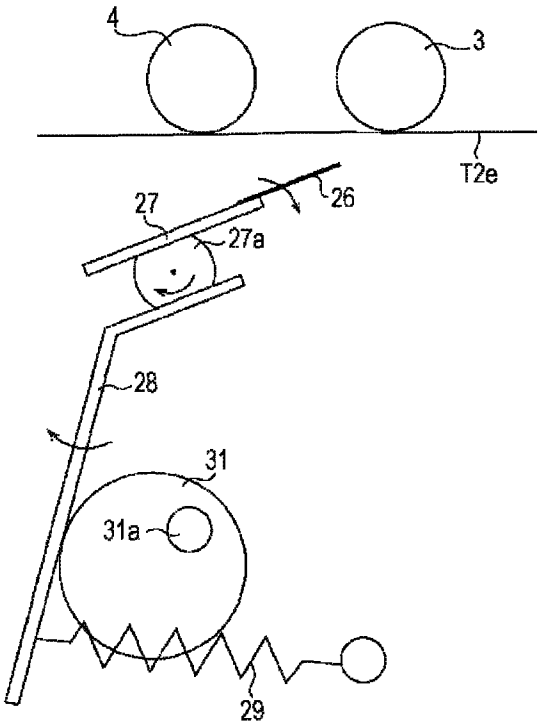
Figure 3A:
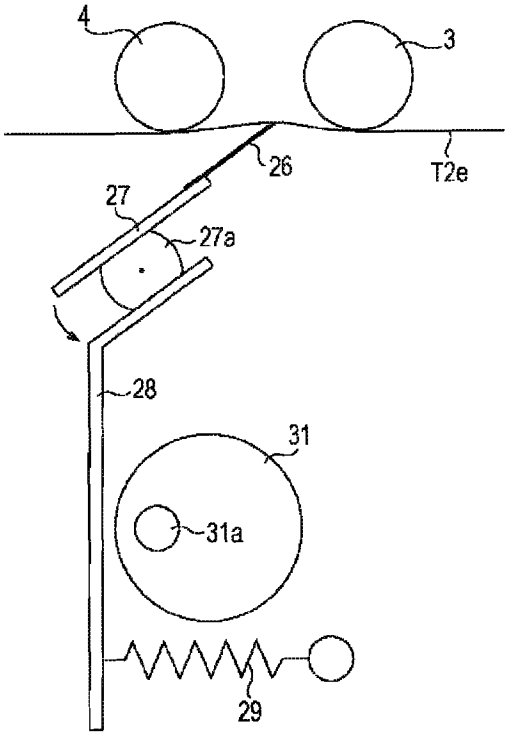

FIGS. 3A and 3B are diagrams for explaining a movement of the first cleaning member according to the first exemplary embodiment. FIG. 3A illustrates a state in which the first cleaning member has been moved to a position where the first cleaning member is in contact with a rotating member. FIG. 3B illustrates a state in which the first cleaning member has been moved to a position separate from the rotating member.

Referring to FIGS. 2, 3A, and 3B, a scraper 26, which is an example of a first cleaning member, is supported between the opposing rollers 3 and 4 in the rotation direction of the transport belt T2*e*. The scraper 26 according to the first exemplary embodiment is a thin plate-shaped metal member that extends in the front-back direction. The scraper 26 is supported such that a tip end portion thereof is capable of coming into contact with an outer surface of the transport belt T2*e* at a position between the opposing rollers 3 and 4.

A base end portion of the scraper 26 is supported by a holder 27, which is an example of a support member. The holder 27 is supported so as to be rotatable around a rotating shaft 27*a*, which is an example of a rotation center portion. A link 28, which is an example of a connection member, is supported so as to be in contact with a lower right surface of the rotating shaft 27*a*. The link 28 is a rod-shaped member that extends toward the lower left and is then bent downward.

The link 28 is connected to an end of a coil spring 29, which is an example of an urging member, at the bottom end thereof. The other end of the coil spring 29 is fixed to the casing 12. The coil spring 29 according to the first exemplary embodiment applies a rightward pulling force to the bottom end of the link 28. A cam 31, which is an example of an eccentric member, is supported above the coil spring 29. The cam 31 includes a rotating shaft 31*a* which receives driving power from a motor (not shown) which is an example of a drive source.

In the first exemplary embodiment, the cam 31 is retained at a position illustrated in FIG. 3B in a standby state in which the image forming operation is not performed. In this state, the cam 31 presses a bottom portion of the link 28 leftward. Therefore, the link 28 and the holder 27 are rotated around the rotating shaft 27*a*, and the scraper 26 is retained such that the tip end portion thereof is separated from the transport belt T2*e*.

When the cam 31 is rotated from the position illustrated in FIG. 3B to the position illustrated in FIG. 3A, the cam 31 becomes separated from the link 28. In this state, owing to the pulling force applied by the coil spring 29, the link 28 and the holder 27 rotate around the rotating shaft 27*a* counterclockwise in FIGS. 3A and 3B. Accordingly, the tip end portion of the scraper 26 comes into contact with the transport belt T2*e*. At this time, the scraper 26 comes into contact with the transport belt T2*e* at a predetermined contact pressure in accordance with the force applied by the coil spring 29.

The holder 27, the link 28, the coil spring 29, the cam 31, and the motor (not shown) constitute a moving member 27-31 according to the first exemplary embodiment.

Controller of First Exemplary Embodiment

Figure 4:
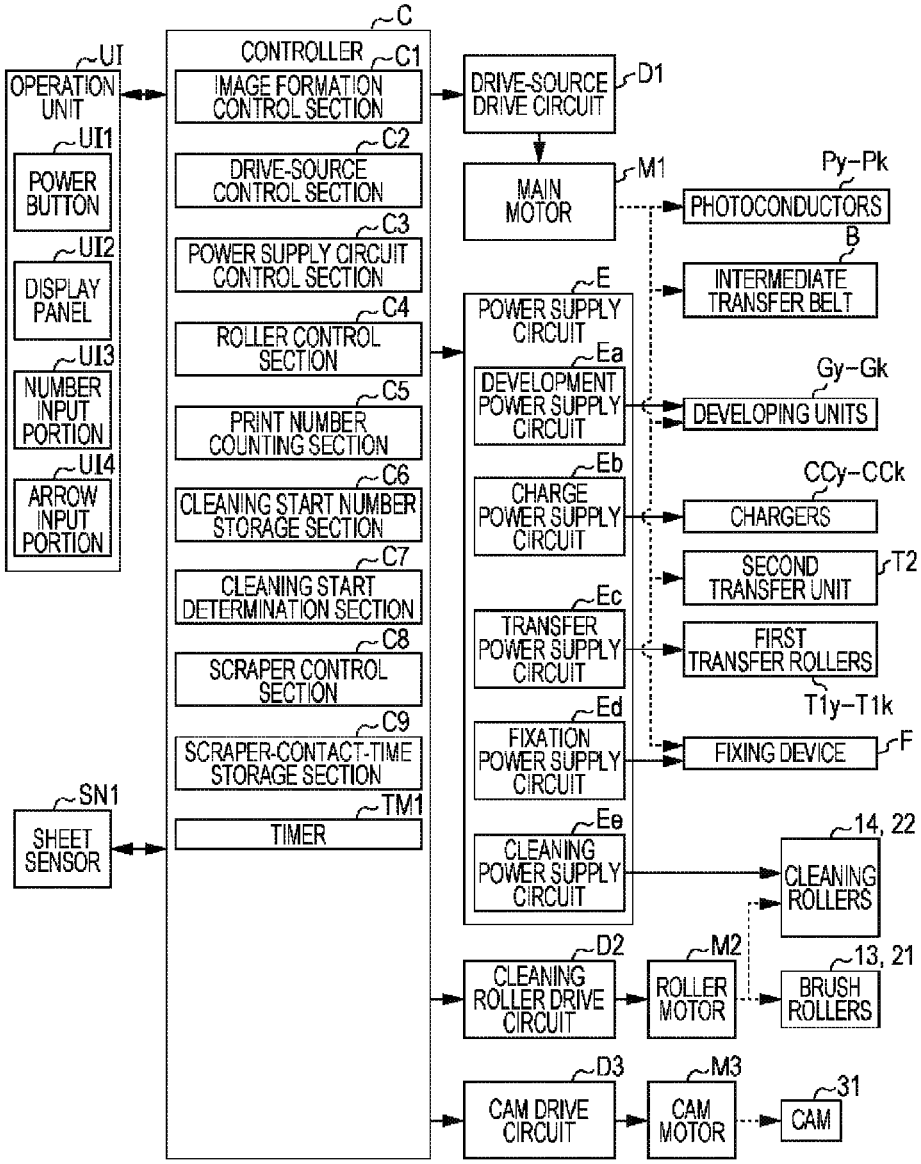
FIG. 4 is a block diagram illustrating functions provided by a controller included in the image forming apparatus according to the first exemplary embodiment.

FIG. 4 is a block diagram illustrating functions provided by the controller included in the image forming apparatus U according to the first exemplary embodiment.

Referring to FIG. 4, the controller C of the printer body U3 includes an input-output interface I/O through which signals are input from and output to an external device. The controller C includes a read-only memory (ROM) in which programs, information, etc., used to perform necessary processes are stored. The controller C also includes a random access memory (RAM) in which necessary data is temporarily stored. The controller C also includes a central processing unit (CPU) that performs processes in accordance with the programs stored in the ROM or the like. The controller C according to the first exemplary embodiment is formed of a so-called microcomputer, which is a small information processor. The controller C is capable of performing various functions by executing the programs stored in the ROM or the like.

Signal Output Elements Connected to Controller C of Printer Body U3

The controller C of the printer body U3 receives signals output from signal output elements, such as the operation unit UI.

The operation unit UI includes a power button UI1, which is an example of a power supply unit, a display panel UI2, which is an example of a display unit, a number input portion UI3, and an arrow input portion UI4.

Elements to be Controlled Connected to Controller C of Printer Body U3

The controller C of the printer body U3 is connected to a drive-source drive circuit D1, a power supply circuit E, a cleaning roller drive circuit D2, which is an example of a cleaning-rotating-member drive circuit, a cam drive circuit D3, which is an example of a moving-member drive circuit, and other elements to be controlled that are not illustrated. The controller C outputs control signals to the circuits D1 to D3 and E and other elements.

D1: Drive-Source Drive Circuit

The drive-source drive circuit D1 rotates the photoconductors Py to Pk and the intermediate transfer belt B through a motor M1, which is an example of a drive source.

D2: Cleaning Roller Drive Circuit

The cleaning roller drive circuit D2 controls the rotations of the brush rollers 13 and 21 and the cleaning rollers 14 and 22 by controlling the operation of a roller motor M2.

D3: Cam Drive Circuit

The cam drive circuit D3 controls the rotational position of the cam 31 by controlling the rotation of a cam motor M3.

E: Power Supply Circuit

The power supply circuit E includes a development power supply circuit Ea, a charge power supply circuit Eb, a transfer power supply circuit Ec, a fixation power supply circuit Ed, and a cleaning power supply circuit Ee, which is an example of a cleaning-device power supply circuit.

Ea: Development Power Supply Circuit

The development power supply circuit Ea applies a developing voltage to developing rollers of the developing units Gy to Gk.

Eb: Charge Power Supply Circuit

The charge power supply circuit Eb applies a charge voltage for charging the surfaces of the photoconductors Py to Pk to the charging units CCy to CCk.

Ec: Transfer Power Supply Circuit

The transfer power supply circuit Ec applies transfer voltages to the first transfer rollers T1*y* to T1*k* and the second transfer roller T2*b*.

Ed: Fixation Power Supply Circuit

The fixation power supply circuit Ed supplies heating electric power to the heating roller Fh of the fixing device F.

Ee: Cleaning Power Supply Circuit

The cleaning power supply circuit Ee applies voltages V1 and V2 to the cleaning rollers 14 and 22, respectively, for electrostatically transferring the developers from the brush rollers 13 and 21 to the cleaning rollers 14 and 22.

Function of Controller C of Printer Body U3

The controller C of the printer body U3 performs processes corresponding to the signals input from the signal output elements and outputs control signals to the elements to be controlled. Specifically, the controller C functions as the following sections.

C1: Image Formation Control Section

An image formation control section C1 executes a job, that is, an image forming operation, by controlling operations of components of the printer U, times at which voltages are applied, etc., in accordance with the image information input from the scanner unit U1.

C2: Drive-Source Control Section

A drive-source control section C2 controls the operation of the photoconductors Py to Pk by controlling the operation of the motor M1 through the drive-source drive circuit D1.

C3: Power-Supply-Circuit Control Section

A power-supply-circuit control section C3 controls the voltages applied to the components and the electric power supplied to the components by controlling the power supply circuits Ea to Ee.

C4: Roller Control Section

A roller control section C4 controls the rotations of the brush rollers 13 and 21 and the cleaning rollers 14 and 22 through the cleaning roller drive circuit D2. The roller control section C4 according to the first exemplary embodiment starts to rotate the brush rollers 13 and 21 and the cleaning rollers 14 and 22 when the job is started and stops rotating the brush rollers 13 and 21 and the cleaning rollers 14 and 22 when the job is finished.

C5: Print Number Counting Section

A print number counting section C5 counts a print number N1, which is the number of sheets that have been subjected to the printing operation during the job.

C6: Cleaning Start Number Storage Section

A cleaning start number storage section C6, which is an example of a cleaning start time storage section, stores a start number Na as an example of a time at which cleaning of the transport belt T2*e* by the scraper 26 is to be started. In the first exemplary embodiment, Na=3000 is stored as an example of the start number Na.

C7: Cleaning Start Determination Section

A cleaning start determination section C7 determines whether or not it is time to start cleaning the transport belt T2*e*. The cleaning start determination section C7 according to the first exemplary embodiment determines that it is time to start cleaning the transport belt T2*e* when the counted print number N1 is greater than or equal to the start number Na.

C8: Scraper Control Section

A scraper control section C8, which is an example of a first-cleaning-member movement control section, controls the movement of the scraper 26 through the cam drive circuit D3. The scraper control section C8 according to the first exemplary embodiment rotates the cam 31 to bring the scraper 26 into contact with the transport belt T2*e* when the cleaning start determination section C7 determines that it is time to start cleaning. The scraper control section C8 according to the first exemplary embodiment rotates the cam 31 to separate the scraper 26 from the transport belt T2*e* after a predetermined time has elapsed since the scraper 26 was brought into contact with the transport belt T2*e*.

C9: Scraper-Contact-Time Storage Section

A scraper-contact-time storage section C9, which is an example of a cleaning time storage section, stores a contact time t1 for which the scraper 26 is to be in contact with the transport belt T2*e*. In the first exemplary embodiment, the contact time t1 is set to the time in which the transport belt T2*e* rotates three turns.

TM1: timer

A timer TM, which is an example of a timing section, measures time.

Flowchart of First Exemplary Embodiment

A control process performed by the printer U according to the first exemplary embodiment will now be described with reference to a flowchart.

Flowchart of Cleaner Control Process

Figure 5:
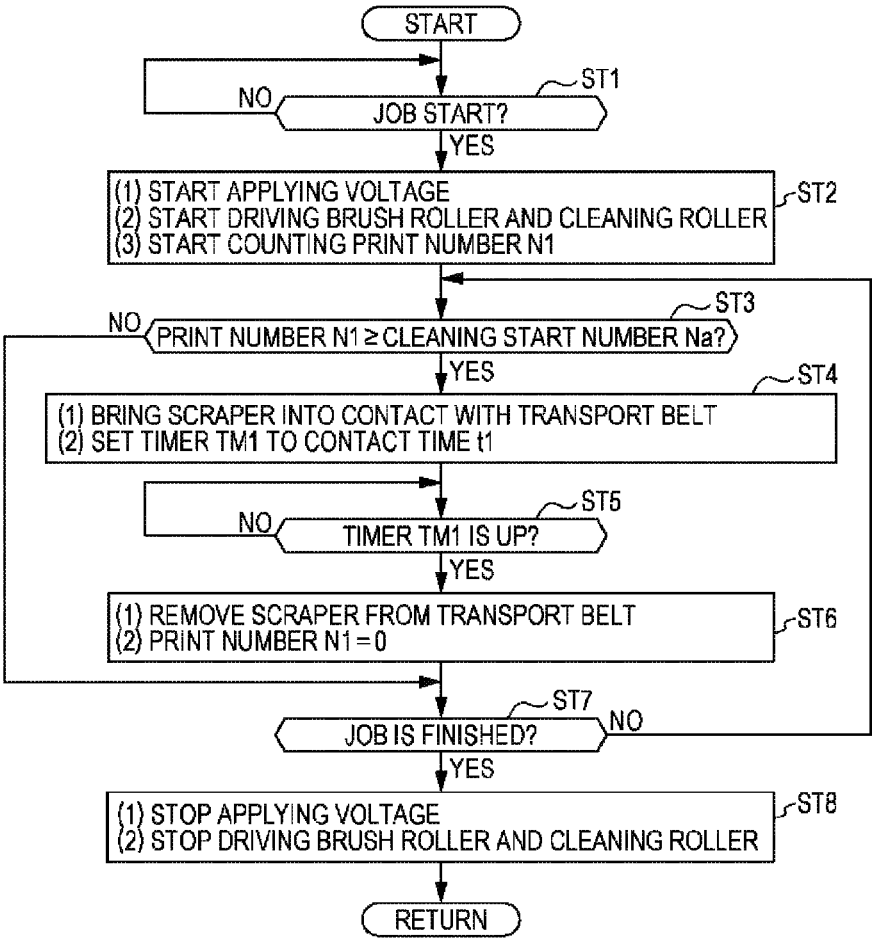
FIG. 5 is a flowchart of a cleaner control process according to the first exemplary embodiment.

FIG. 5 is a flowchart of a cleaner control process according to the first exemplary embodiment.

Steps ST of the flowchart illustrated in FIG. 5 are performed in accordance with the programs stored in the controller C of the printer U. These steps ST are executed simultaneously with other various processes performed by the printer U.

The flowchart illustrated in FIG. 5 is started when the printer U is powered on.

In ST1 of FIG. 5, it is determined whether or not the image forming operation, that is, a job, has been started. When the result of the determination is Yes (Y), the process proceeds to ST2. When the result of the determination is No (N), ST1 is repeated.

In ST2, the following processes (1) to (3) are performed. Subsequently, the process proceeds to ST3.

(1) Application of the voltages V1 and V2 to the cleaning rollers 14 and 22, respectively, is started.

(2) Driving of the brush rollers 13 and 21 and the cleaning rollers 14 and 22 is started.

(3) Counting of the print number N1 is started.

In ST3, it is determined whether or not the print number N1 is greater than or equal to the cleaning start number Na. When the result of the determination is Yes (Y), the process proceeds to ST4. When the result of the determination is No (N), the process proceeds to ST7.

In ST4, the following processes (1) and (2) are performed. Subsequently, the process proceeds to ST5.

(1) The cam 31 is rotated so as to bring the scraper 26 into contact with the transport belt T2*e*.

(2) The timer TM1 is set to the contact time t1.

In ST5, it is determined whether or not the timer TM1 is up. In other words, it is determined whether or not the contact time t1 has elapsed. When the result of the determination is Yes (Y), the process proceeds to ST6. When the result of the determination is No (N), ST5 is repeated.

In ST6, the following processes (1) and (2) are performed. Subsequently, the process proceeds to ST7.

(1) The cam 31 is rotated so as to separate the scraper 26 from the transport belt T2*e*.

(2) The print number N1 is initialized. In other words, N1=0 is set.

In ST7, it is determined whether or not the job is finished. When the result of the determination is Yes (Y), the process proceeds to ST8. When the result of the determination is No (N), the process returns to ST3.

In ST8, the following processes (1) and (2) are performed. Subsequently, the process returns to ST1.

(1) Application of the voltages V1 and V2 to the cleaning rollers 14 and 22, respectively, is stopped.

(2) Driving of the brush rollers 13 and 21 and the cleaning rollers 14 and 22 is stopped.

Function of Cleaner 11 for Transport Belt T2*e* of First Exemplary Embodiment In the printer U according to the first exemplary embodiment having the above-described structure, when the job is started, driving of the brush rollers 13 and 21 and the cleaning rollers 14 and 22 is started. At this time, the voltages V1 and V2 are applied to the cleaning rollers 14 and 22, respectively. The scraper 26 is retained at the position where the scraper 26 is separated from the transport belt T2*e*.

In the second transfer region Q4, since the intermediate transfer belt B and the transport belt T2*e* are in contact with each other, developers, discharge products, paper dust, etc., that have adhered to the intermediate transfer belt B may be transferred onto the transport belt T2*e*. In addition, when the recording sheet S passes through the second transfer region Q4, paper dust on the recording sheet S may be transferred onto the transport belt T2*e*. When a recycled recording sheet S that has an image recorded on one side thereof is used, developers and the like may be transferred onto the transport belt T2*e*.

The brush rollers 13 and 21 remove the substances attached to the transport belt T2*e* from the transport belt T2*e*. The cleaning rollers 14 and 22 electrostatically attract and receive the attached substances that have been removed by the brush rollers 13 and 21. In the first exemplary embodiment, negatively charged attached substances are collected by the upstream cleaning roller 14, and positively charged attached substances are collected by the downstream cleaning roller 22.

The attached substances that have been transferred onto the cleaning rollers 14 and 22 are scraped off by the scrapers 16 and 23. The attached substances scraped off by the scrapers 16 and 23 are collected in the receiving chamber 12*a*.

When the accumulated print number becomes greater than or equal to the start number Na, the scraper 26 is brought into contact with the transport belt T2*e*. In the first exemplary embodiment, the job is temporarily stopped at this time.

The scraper 26 that has been brought into contact with the transport belt T2*e* scrapes off the developers and paper dust that have adhered to the surface of the transport belt T2*e* and toner films, which are thin films of developers fixed to the surface of the transport belt T2*e*. The attached substances, such as the developers and toner films, scraped off by the scraper 26 are collected in the receiving chamber 12*a*.

The scraper 26 is separated from the transport belt T2*e* after the transport belt T2*e* rotates three turns.

Figure 6:
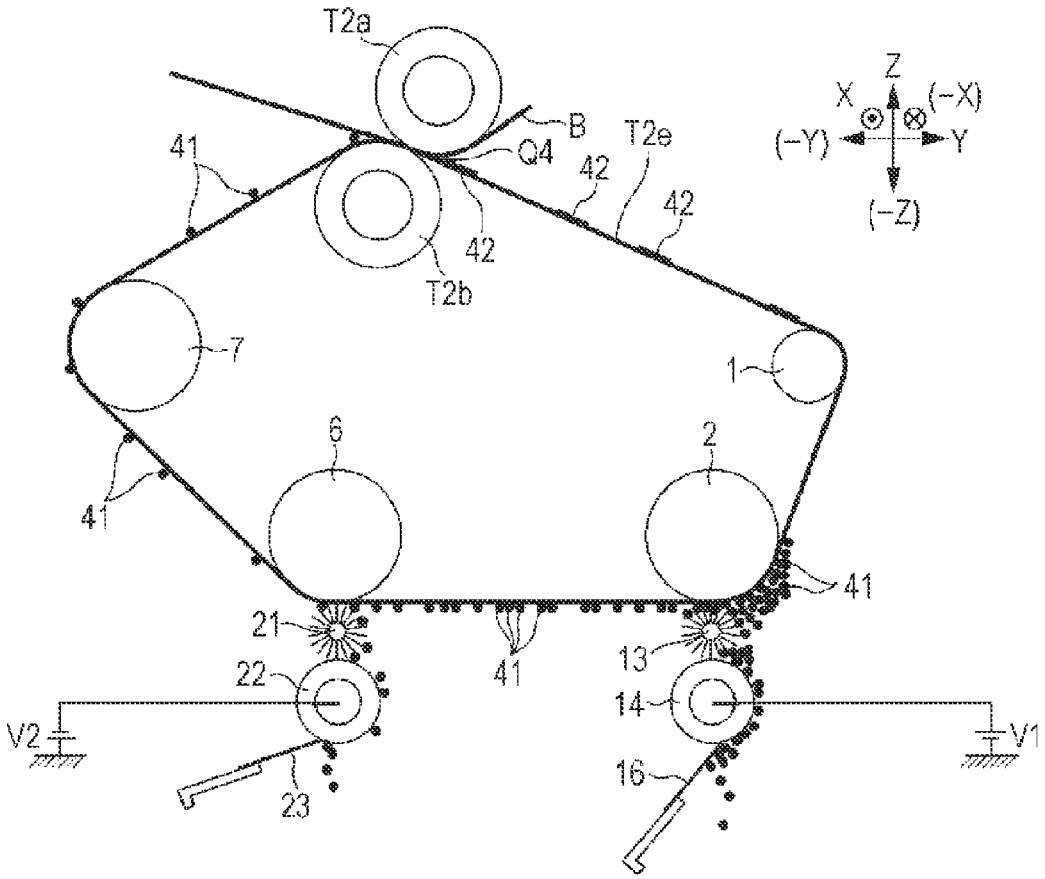
FIG. 6 illustrates a problem that occurs when a cleaning process is performed only by brush rollers.

FIG. 6 illustrates a problem that occurs when the cleaning process is performed only by the brush rollers.

When the brush rollers 13 and 21 are used in the cleaner 11, it is structurally difficult to completely remove the attached substances with the brush rollers 13 and 21. Therefore, some of the attached substances 41 pass the brush rollers 13 and 21 and are transported downstream as the transport belt T2*e* rotates. When the attached substances 41 that have been transported downstream enter the second transfer region Q4, the attached substances 41 receive a contact pressure between the intermediate transfer belt B and the transport belt T2*e*. As a result, there is a risk that the developers will be fixed and toner films 42 will be generated.

In the case where a stretchable rubber belt is used as the transport belt T2*e*, the toner films are easily removed as the transport belt T2*e* stretches and contracts when being wrapped around the rollers T2*b* and 1 to 7. However, when the transport belt T2*e* is made of a highly durable, long-life polyimide resin, the transport belt T2*e* hardly stretches and the toner films are not easily removed. In the case where a polyimide resin that hardly stretches is used, buffering or cushioning performance is lower than that of a rubber belt, and the pressure applied in the second transfer region Q4 tends to be high. In other words, when the transport belt T2*e* is formed of a polyimide resin, the toner films 42 are easily generated.

When the toner films 42 are generated, it is difficult to remove the toner films 42 on the transport belt T2*e* with the brush rollers 13 and 21. Therefore, there is a problem that the toner films 42 cannot be removed with a brush or a web.

The surface of the intermediate transfer belt B is often coated with fluorocarbon resin having a high releasability to reduce the occurrence of a cleaning failure. Therefore, the toner films 42 are more easily generated on the transport belt T2*e* than on the intermediate transfer belt B.

The toner films 42 do not largely affect the image when the amount thereof is small. However, when the amount of toner films 42 is large, there is a risk that the toner films 42 will be fixed to the intermediate transfer belt B instead of the transport belt T2*e*. Thus, there is a risk that the toner films 42 will be generated on the intermediate transfer belt B. When the toner films 42 are formed on the intermediate transfer belt B, there is a risk that the belt cleaner CLB will fail to sufficiently clean the surface of the intermediate transfer belt B. As a result, the surface resistance of the intermediate transfer belt B may vary due to soil left on the intermediate transfer belt B because of the cleaning failure, and a transfer failure may occur in the first transfer regions Q3 and the second transfer region Q4. Accordingly, there is a risk that the image quality will be reduced owing to the transfer failure.

Therefore, the scraper 26, which is structured so as to have a higher capability of removing the toner films 42 compared to the brush rollers 13 and 21, may be used to remove the toner films 42.

However, when the scraper 26 is constantly in contact with the transport belt T2*e*, there is a problem that the transport belt T2*e* will more easily wear compared to the case in which the brush rollers 13 and 21 are used. Therefore, the scraper 26 may be brought into contact with the transport belt T2*e* when the toner films 42 are to be removed, and be separated from the transport belt T2*e* in a normal operation.

Figure 7A:
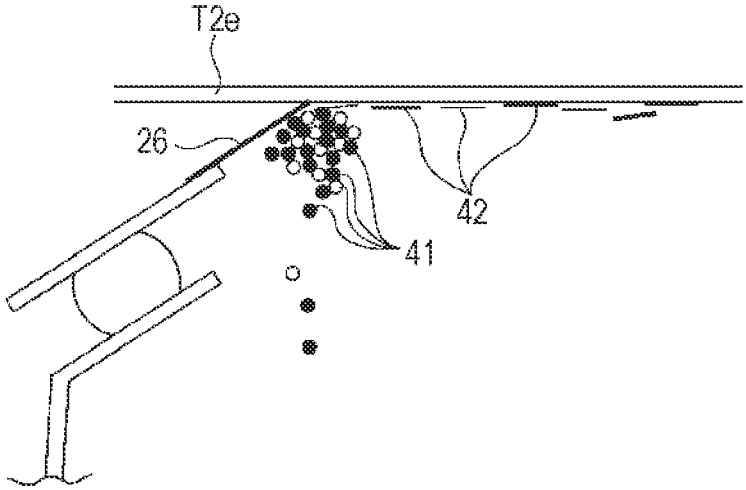
Figure 7B:
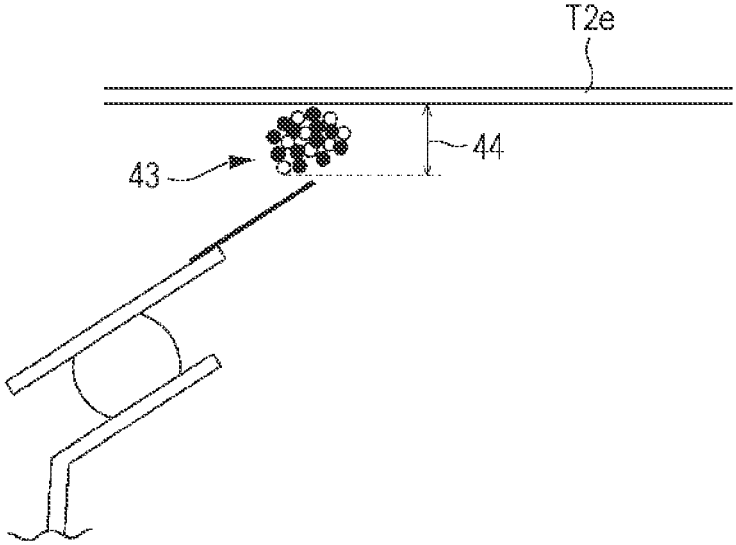

FIGS. 7A and 7B are diagrams for explaining a problem that occurs when the scraper 26 is separated from the transport belt T2*e*. FIG. 7A illustrates a state in which the scraper 26 is in contact with the transport belt T2*e*. FIG. 7B illustrates a state in which the scraper 26 is separated from the transport belt T2*e*.

Referring to FIGS. 7A and 7B, assume that the scraper 26 may be brought into contact with and separated from the transport belt T2*e*. When the scraper 26 is in contact with the transport belt T2*e*, the attached substances 41 that have been scraped off may be temporarily collected upstream of the tip end portion of the scraper 26. The scraper 26 blocks the attached substances 41, and the attached substances 41 in the blocked state form a toner aggregate 43.

If the scraper 26 is separated from the transport belt T2*e* while the toner aggregate 43 is formed, the toner aggregate 43 is transported downstream as the transport belt T2*e* rotates. In the case where, for example, a brush, a brush, and a scraper are arranged in that order and the scraper may be brought into contact with and separated from a transport belt, the toner aggregate 43 will be transported to a transfer region instead of being removed when the scraper is separated from the transport belt. Therefore, there is a high possibility that the toner aggregate 43 will be formed into a toner film. The toner aggregate 43 often has a greater pile height 44, which is a height from the surface of the transport belt T2*e*, than that of the attached substances 41 that have not been removed by the brush rollers 13 and 21. Therefore, when the toner aggregate 43 enters the transfer region, the toner aggregate 43 easily receives a high pressure. As a result, the toner films 42 are more easily generated compared to the case in which the attached substances 41 enter the transfer region.

Figure 8A:
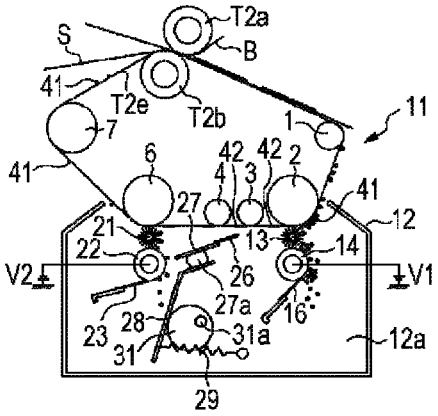
Figure 8C:
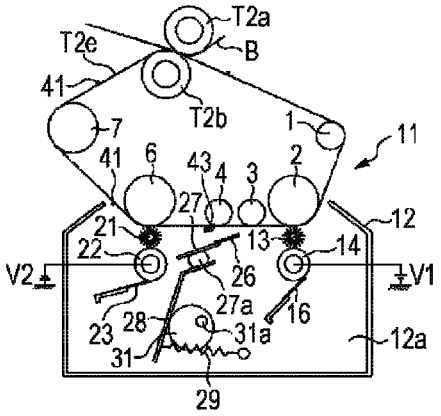
Figure 8B:
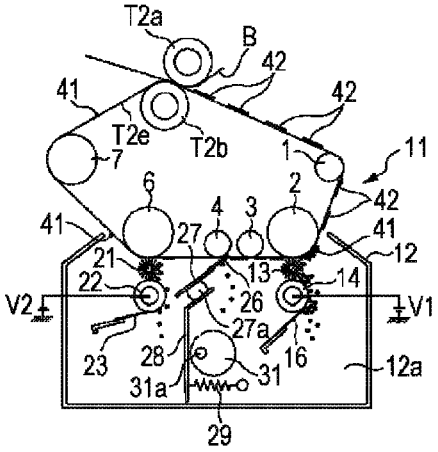
Figure 8D:
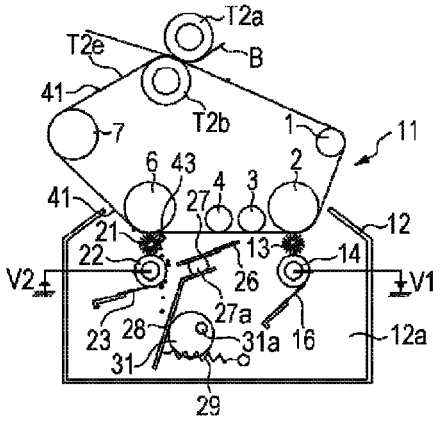

FIGS. 8A to 8D are diagrams for explaining the operation of the cleaner 11 according to the first exemplary embodiment. FIG. 8A illustrates a state in which an image is being formed. FIG. 8B illustrates a state in which the scraper 26 is in contact with the transport belt T2*e*. FIG. 8C illustrates a state in which the scraper 26 is separated from the transport belt T2*e* and the toner aggregate 43 has started to move downstream. FIG. 8D illustrates a state in which the toner aggregate 43 has been removed.

In the cleaner 11 according to the first exemplary embodiment, the downstream brush roller 21 is disposed downstream of the scraper 26 and upstream of the second transfer region Q4. As illustrated in FIG. 8A, the scraper 26 is separated from the transport belt T2*e* and the attached substances are removed by the brush rollers 13 and 21 when a job is being performed. When the scraper 26 is brought into contact with the transport belt T2*e* as illustrated in FIG. 8B, the scraper 26 removes the attached substances including the toner films 42 attached to the surface of the transport belt T2*e*. When the scraper 26 is separated from the transport belt T2*e* as illustrated in FIG. 8C, the toner aggregate 43 that has been formed on the tip end portion of the scraper 26 is transported downstream. Referring to FIG. 8D, the toner aggregate 43 is removed by the downstream brush roller 21.

Thus, in the cleaner 11 according to the first exemplary embodiment, the toner aggregate 43 does not easily enter the second transfer region Q4. The toner films 42 are removed by the scraper 26, and the scraper 26 is not constantly in contact with the transport belt T2*e* so that the life of the transport belt T2*e* may be increased. In addition, generation of the toner films 42 from the toner aggregate 43 may be suppressed.

In the cleaner 11 according to the first exemplary embodiment, the scraper 26 is disposed between the brush rollers 13 and 21 in the casing 12. The scraper 26 generally has a higher capability of removing the toner films 42, paper dust, etc., compared to the brush rollers 13 and 21, but has a relatively low capability of removing the developers. If a large amount of developers reach the tip end portion of the scraper 26, there is a risk that the developers cannot be completely removed by the scraper 26. The developers may pass the tip end portion of the scraper 26, and the toner films 42 may pass the tip end portion of the scraper 26 together with the developers. In contrast, in the cleaner 11 according to the first exemplary embodiment, the upstream brush roller 13 removes a certain amount of developers from the transport belt T2*e* before the transport belt T2*e* reaches the scraper 26. Therefore, the risk that the scraper 26 will receive an excessive amount of developers and fail to remove the toner films 42 is reduced.

In the case where the scraper 26 is not disposed between the brush rollers 13 and 21, the attached substances removed by the brush rollers 13 and 21 tend to be collected in the left and right areas of the casing 12 and only a small amount of attached substances is collected in a central area. Thus, there is a risk that the capacity of the receiving chamber 12*a* cannot be efficiently used. In contrast, in the first exemplary embodiment, since the scraper 26 is disposed between the brush rollers 13 and 21, the attached substances are also collected in the central area of the casing 12. Therefore, the receiving chamber 12*a* may be efficiently used.

Second Exemplary Embodiment

Figure 9:
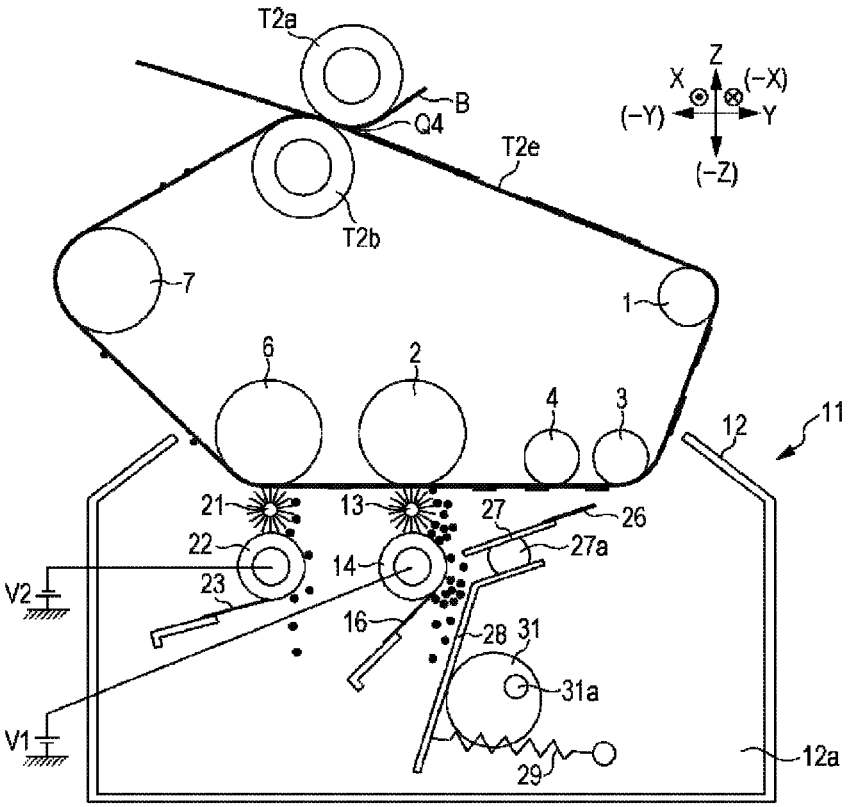
FIG. 9 corresponds to FIG. 2 of the first exemplary embodiment, and illustrates a cleaner according to a second exemplary embodiment of the present invention.

FIG. 9 corresponds to FIG. 2 of the first exemplary embodiment, and illustrates a cleaner 11 according to a second exemplary embodiment of the present invention.

The second exemplary embodiment of the present invention will now be described. In the description of the second exemplary embodiment, components similar to those of the first exemplary embodiment are denoted by the same reference numerals, and detailed explanations thereof are thus omitted. The second exemplary embodiment is similar to the first exemplary embodiment expect for the differences described below.

Referring to FIG. 9, the structure of the cleaner 11 of the second exemplary embodiment differs from that of the first exemplary embodiment in that the position of the upstream brush roller 13, the upstream cleaning roller 14, and the upstream scraper 16 and the position of the scraper 26 are switched. Accordingly, the position of the first driven roller 2 associated with the upstream brush roller 13 and the position of the opposing rollers 3 and 4 associated with the scraper 26 are also switched.

Figure 10:
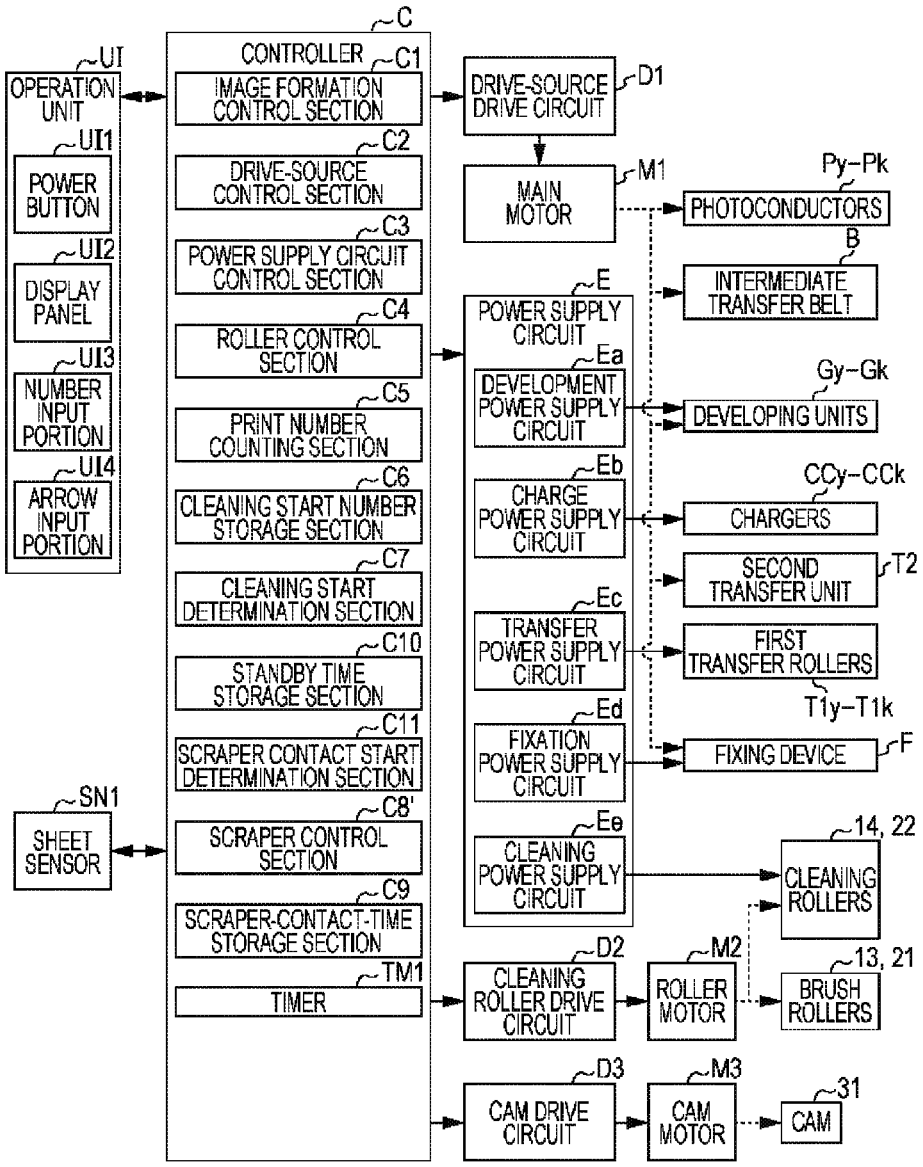
FIG. 10 corresponds to FIG. 4 of the first exemplary embodiment, and illustrates a controller according to the second exemplary embodiment.

FIG. 10 corresponds to FIG. 4 of the first exemplary embodiment, and illustrates a controller C according to the second exemplary embodiment.

Referring to FIG. 10, the controller C included in the printer U according to the second exemplary embodiment includes a scraper control section C8' in place of the scraper control section C8 according to the first exemplary embodiment. In addition, the controller C additionally includes a standby time storage section C10 and a scraper contact start determination section C11.

C10: Standby Time Storage Section

The standby time storage section C10 stores a standby time t2, which is a time for which the scraper 26 is caused to wait at a position separate from the transport belt T2*e* before coming into contact with the transport belt T2*e* when the cleaning start determination section C7 determines that it is time to start cleaning the transport belt T2*e*. In the second exemplary embodiment, the standby time t2 is set to, for example, the time in which the transport belt T2*e* rotates one turn.

C11: Scraper Contact Start Determination Section

The scraper contact start determination section C11, which is an example of a first-cleaning-member contact start determination section, determines whether or not it is time to bring the scraper 26 into contact with the transport belt T2*e*. The scraper contact start determination section C11 according to the second exemplary embodiment determines that it is time to bring the scraper 26 into contact with the transport belt T2*e* when the standby time t2 has elapsed.

C8': Scraper Control Section

When the scraper contact start determination section C11 determines that it is time to bring the scraper 26 into contact with the transport belt T2*e*, the scraper control section C8' according to the second exemplary embodiment rotates the cam 31 to bring the scraper 26 into contact with the transport belt T2*e*.

Flowchart of Second Exemplary Embodiment

Figure 11:
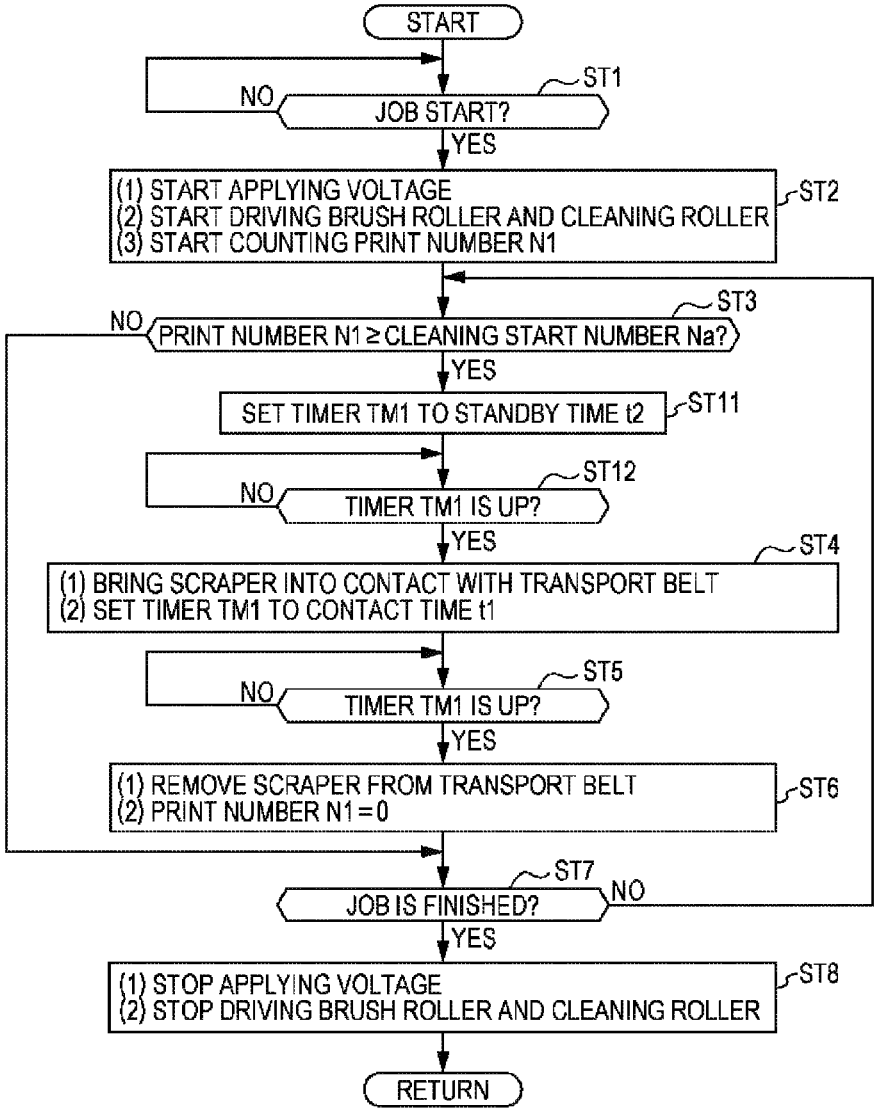
FIG. 11 corresponds to FIG. 5 of the first exemplary embodiment, and is a flowchart of a cleaner control process according to the second exemplary embodiment.

FIG. 11 corresponds to FIG. 5 of the first exemplary embodiment, and is a flowchart of a cleaner control process according to the second exemplary embodiment.

The cleaner control process according to the second exemplary embodiment will now be described. Steps similar to those in the first exemplary embodiment are denoted by the same step numbers, and detailed explanations thereof are thus omitted.

Referring to FIG. 11, the cleaner control process according to the second exemplary embodiment differs from that of the first exemplary embodiment in that ST11 and ST12 are performed between ST3 and ST4.

In ST11, the timer TM1 is set to the standby time t2. Subsequently, the process proceeds to ST12.

In ST12, it is determined whether or not the timer TM1 is up. In other words, it is determined whether or not the standby time t2 has elapsed. When the result of the determination is Yes (Y), the process proceeds to ST4. When the result of the determination is No (N), ST12 is repeated.

Function of Cleaner 11 of Second Exemplary Embodiment

Figure 12A:
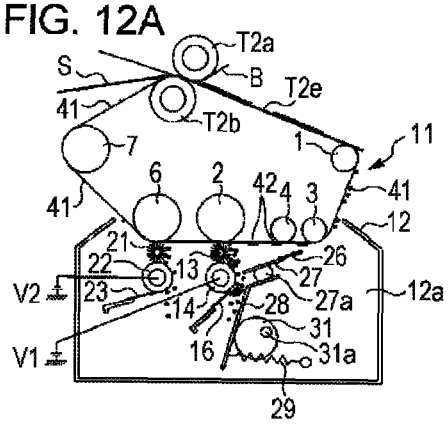
Figure 12D:
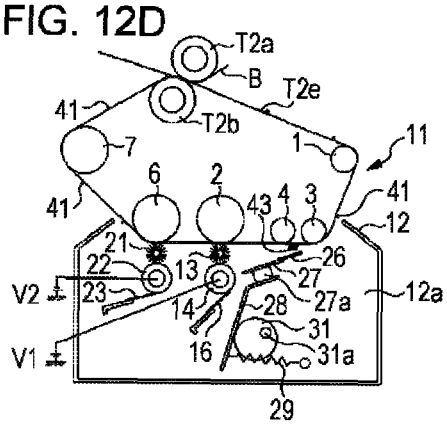
Figure 12B:
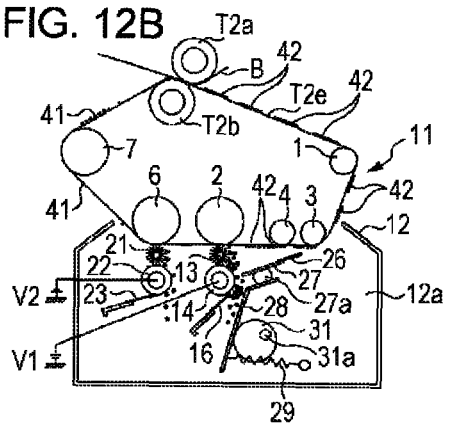
Figure 12E:
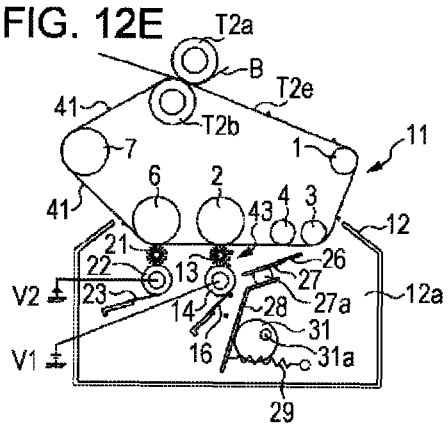
Figure 12C:
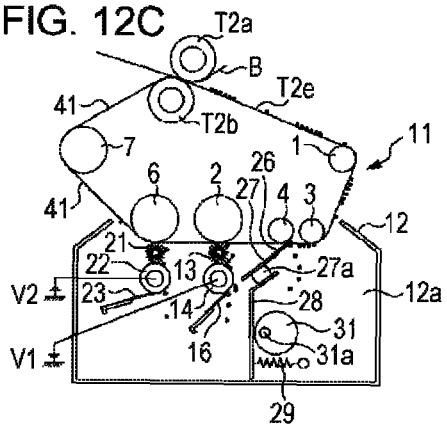

FIGS. 12A to 12E are diagrams for explaining the operation of the cleaner 11 according to the second exemplary embodiment. FIG. 12A illustrates a state in which an image is being formed. FIG. 12B illustrates a state in which the scraper 26 is in a standby state after an operation of cleaning the transport belt T2*e* has been started. FIG. 12C illustrates a state in which the scraper 26 is in contact with the transport belt T2*e*. FIG. 12D illustrates a state in which the scraper 26 is separated from the transport belt T2*e* and the toner aggregate 43 has started to move downstream. FIG. 12E illustrates a state in which the toner aggregate 43 has been removed.

In the cleaner 11 according to the second exemplary embodiment having the above-described structure, in the image forming operation, the scraper 26 is retained at the position where the scraper 26 is separated from the transport belt T2*e*, as illustrated in FIG. 12A. Therefore, the transport belt T2*e* is cleaned by the brush rollers 13 and 21.

When the transport belt T2*e* is cleaned by using the scraper 26, the scraper 26 waits for the transport belt T2*e* to rotate one turn before coming into contact with the transport belt T2*e*, as illustrated in FIG. 12B. During this time, the job is temporarily stopped. Therefore, the surface of the transport belt T2*e* is cleaned by the brush rollers 13 and 21 while the transport belt T2*e* rotates one turn in such a state that the job is stopped and no additional developers adhere to the transport belt T2*e* in the second transfer region Q4.

If the scraper 26 is brought into contact with the transport belt T2*e* immediately after the job is stopped, a part of the transport belt T2*e* between the second transfer region Q4 and the scraper 26 comes into contact with the scraper 26 without being preliminarily cleaned by the brush rollers 13 and 21. Therefore, there is a risk that a large amount of developers will be attached to the surface of the transport belt T2*e* and a cleaning failure of the scraper 26 will occur.

In contrast, in the second exemplary embodiment, the scraper 26 is brought into contact with the surface of the transport belt T2*e* after the surface is preliminarily cleaned by the brush rollers 13 and 21 once. Therefore, the risk of cleaning failure of the scraper 26 is reduced.

Subsequently, similar to the steps illustrated in FIGS. 8B to 8D of the first exemplary embodiment, as illustrated in FIGS. 12C to 12E, the toner aggregate 43 is removed by the upstream brush roller 13 after the scraper 26 is brought into contact with and separated from the transport belt T2*e*. In the second exemplary embodiment, the upstream brush roller 13 functions as a second cleaning member.

Similar to the first exemplary embodiment, the life of the transport belt T2*e* may be increased and generation of the toner films from the toner aggregate 43 may be suppressed by the cleaner 11 of the second exemplary embodiment.

Third Exemplary Embodiment

Figure 13A:
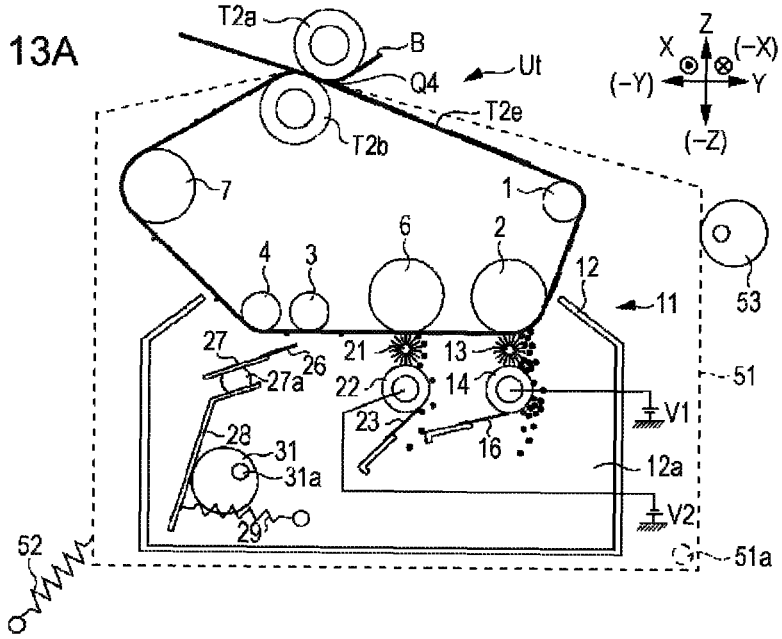
Figure 13B:
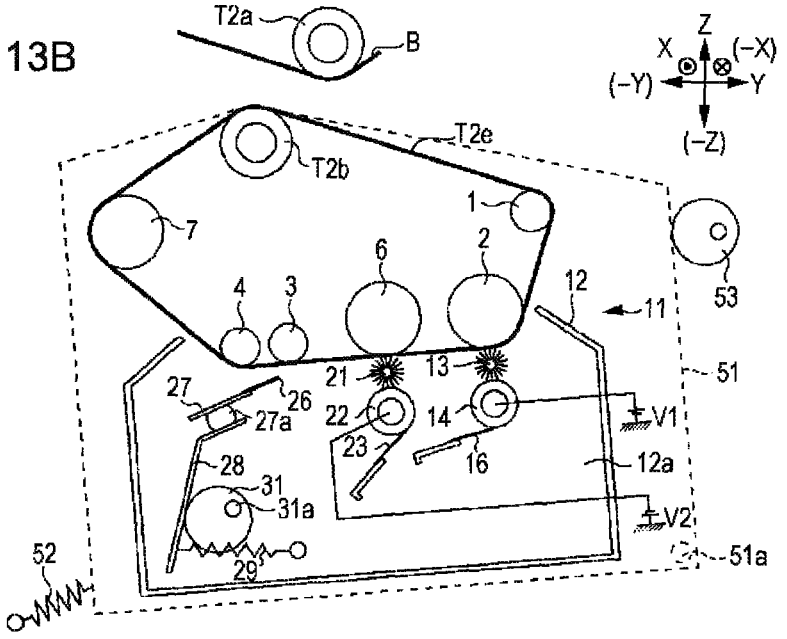

FIGS. 13A and 13B are diagrams for explaining a cleaner 11 according to a third exemplary embodiment of the present invention. FIG. 13A illustrates a state in which the transport belt T2*e* is in contact with the intermediate transfer belt B. FIG. 13B illustrates a state in which the transport belt T2*e* is separated from the intermediate transfer belt B.

The third exemplary embodiment of the present invention will now be described. In the description of the third exemplary embodiment, components similar to those of the first and second exemplary embodiments are denoted by the same reference numerals, and detailed explanations thereof are thus omitted. The third exemplary embodiment is similar to the first and second exemplary embodiments expect for the differences described below.

Referring to FIGS. 13A and 13B, the structure of the cleaner 11 of the third exemplary embodiment differs from that of the first exemplary embodiment in that the position of the downstream brush roller 21, the downstream cleaning roller 22, and the downstream scraper 23 and the position of the scraper 26 are switched. Accordingly, the position of the second driven roller 6 associated with the downstream brush roller 21 and the position of the opposing rollers 3 and 4 associated with the scraper 26 are also switched.

Referring to FIGS. 13A and 13B, in the printer U according to the third exemplary embodiment, a belt unit 51 including the transport belt T2*e*, the second transfer roller T2*b*, the rollers 1 to 6, and the cleaner 11 is supported so as to be rotatable around a rotation center 51*a*.

A coil spring 52, which is an example of an urging member, is connected to a lower left portion of the belt unit 51. The coil spring 52 urges the second transfer roller T2*b* included in the belt unit 51 toward the backup roller T2*a*.

A second cam 53, which is an example of a unit moving member, is disposed on an upper right portion of the belt unit 51. The second cam 53 receives driving power from a second cam motor (not shown), which is an example of a drive source. The second cam 53 is retained at a position illustrated in FIG. 13A during the image forming operation. Accordingly, owing to the urging force applied by the coil spring 52, the transport belt T2*e* is in contact with the intermediate transfer belt B at a predetermined pressure. The second cam 53 may be rotated by 180° from the position illustrated in FIG. 13A to the position illustrated in FIG. 13B. Accordingly, the belt unit 51 is pressed by the second cam 53 and the transport belt T2*e* is separated from the intermediate transfer belt B.

The coil spring 52 and the second cam 53 constitute a belt-unit moving member 52+53, which is an example of a rotating-member moving member.

Figure 14:
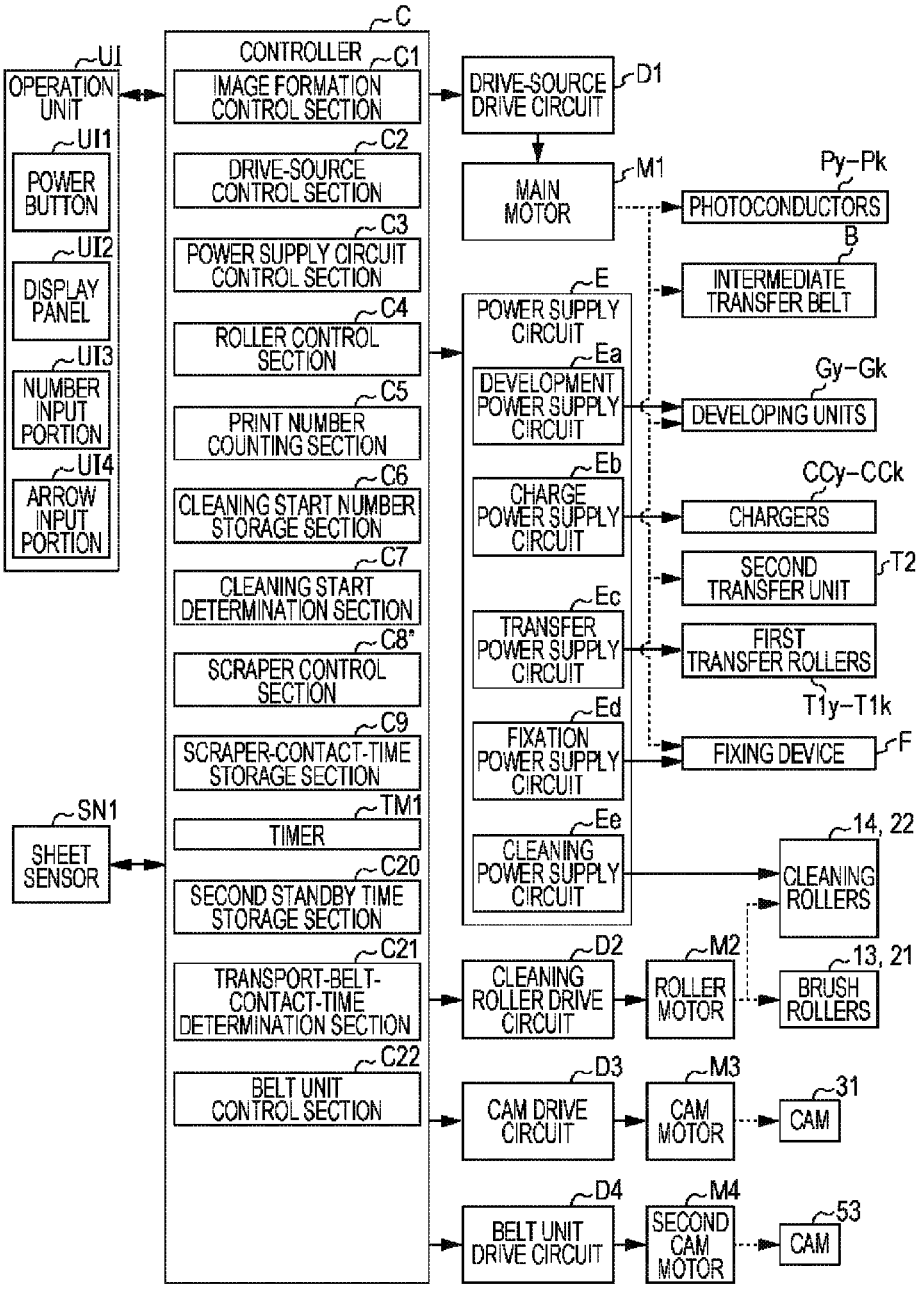
FIG. 14 corresponds to FIG. 4 of the first exemplary embodiment, and illustrates a controller according to the third exemplary embodiment.

FIG. 14 corresponds to FIG. 4 of the first exemplary embodiment, and illustrates a controller C according to the third exemplary embodiment.

Referring to FIG. 14, the controller C included in the printer U according to the third exemplary embodiment includes a scraper control section C8" in place of the scraper control section C8 according to the first exemplary embodiment. In addition, the controller C additionally includes a second-standby-time storage section C20, a transport-belt-contact-time determination section C21, and a belt unit control section C22. The controller C outputs a control signal to a belt unit drive circuit D4.

D4: Belt Unit Drive Circuit

The belt unit drive circuit D4, which is an example of a drive circuit for the rotating-member moving member, controls the rotational position of the second cam 53 by controlling the rotation of a second cam motor M4.

C20: Second-Standby-Time Storage Section

The second-standby-time storage section C20 stores a second standby time t3, which is a time from when the scraper 26 is separated from the transport belt T2*e* to when the transport belt T2*e* is brought into contact with the intermediate transfer belt B. In the third exemplary embodiment, the second standby time t3 is set to, for example, the time in which the transport belt T2*e* rotates one turn.

C21: Transport-Belt-Contact-Time Determination Section

The transport-belt-contact-time determination section C21, which is an example of a rotating-member-contact-time determination section, determines whether or not it is time to bring the transport belt T2*e* into contact with the intermediate transfer belt B. The transport-belt-contact-time determination section C21 according to the third exemplary embodiment determines that it is time to bring the transport belt T2*e* into contact with the intermediate transfer belt B when the second standby time t3 has elapsed.

C22: Belt Unit Control Section

The belt unit control section C22, which is an example of a control section for the rotating-member moving member, controls the position of the belt unit 51. The belt unit control section C22 according to the third exemplary embodiment moves the transport belt T2*e* between the position where it is in contact with the intermediate transfer belt B and the position where it is separated from the intermediate transfer belt B by controlling the rotation of the second cam 53 through the belt unit drive circuit D4. The belt unit control section C22 according to the third exemplary embodiment maintains the state in which the transport belt T2*e* is in contact with the intermediate transfer belt B during the image forming operation. The belt unit control section C22 according to the third exemplary embodiment separates the transport belt T2*e* from the intermediate transfer belt B when the cleaning start determination section C7 determines that it is time to start cleaning the transport belt T2*e*. The belt unit control section C22 according to the third exemplary embodiment brings the transport belt T2*e* into contact with the intermediate transfer belt B when the transport-belt-contact-time determination section C21 determines that it is time to bring the transport belt T2*e* into contact with the intermediate transfer belt B.

Flowchart of Third Exemplary Embodiment

Figure 15:
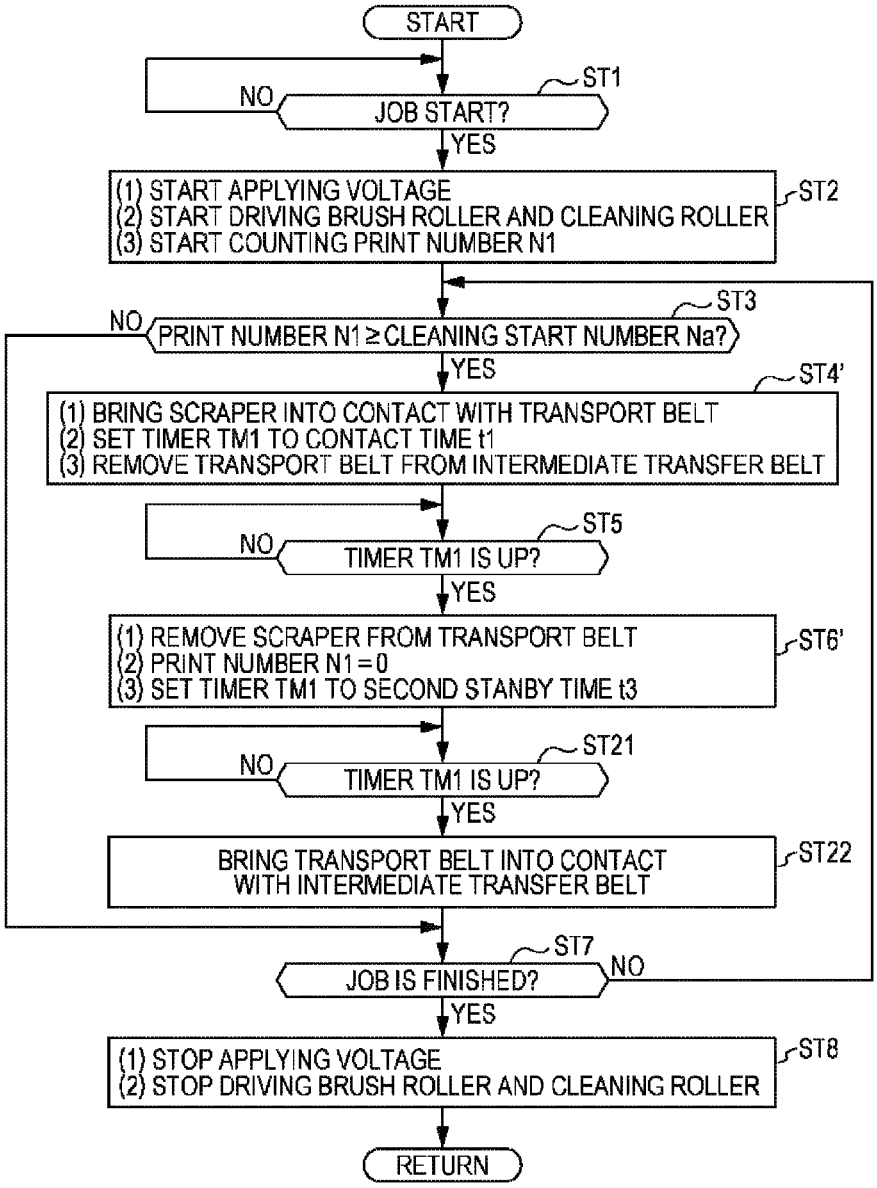
FIG. 15 corresponds to FIG. 5 of the first exemplary embodiment, and is a flowchart of a cleaner control process according to the third exemplary embodiment.

FIG. 15 corresponds to FIG. 5 of the first exemplary embodiment, and is a flowchart of a cleaner control process according to the third exemplary embodiment.

The cleaner control process according to the third exemplary embodiment will now be described. Steps similar to those in the first exemplary embodiment are denoted by the same step numbers, and detailed explanations thereof are thus omitted.

Referring to FIG. 15, the cleaner control process according to the third exemplary embodiment differs from that of the first exemplary embodiment in that ST4' and ST6' are performed instead of ST4 and ST6 and ST21 and ST22 are performed between ST6' and ST7.

In ST4', the following processes (1) to (3) are performed. Subsequently, the process proceeds to ST5.

(1) The cam 31 is rotated so as to bring the scraper 26 into contact with the transport belt T2*e*.

(2) The timer TM1 is set to the contact time t1.

(3) The second cam 53 is rotated so as to separate the transport belt T2*e* from the intermediate transfer belt B.

In ST6', the following processes (1) to (3) are performed. Subsequently, the process proceeds to ST21.

(1) The cam 31 is rotated so as to separate the scraper 26 from the transport belt T2*e*.

(2) The print number N1 is initialized. In other words, N1=0 is set.

(3) The timer TM1 is set to the second standby time t3.

In ST21, it is determined whether or not the timer TM1 is up. In other words, it is determined whether or not the second standby time t3 has elapsed. When the result of the determination is Yes (Y), the process proceeds to ST22. When the result of the determination is No (N), ST21 is repeated.

In ST22, the second cam 53 is rotated so as to bring the transport belt T2*e* into contact with the intermediate transfer belt B. Subsequently, the process proceeds to ST7.

Function of Cleaner 11 of Third Exemplary Embodiment

Figure 16A:
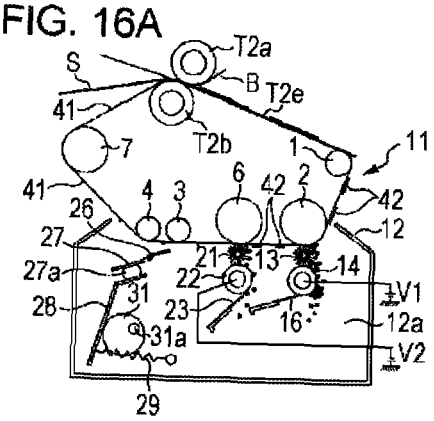
Figure 16D:
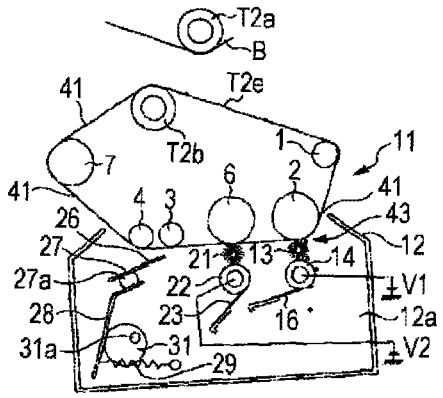
Figure 16B:
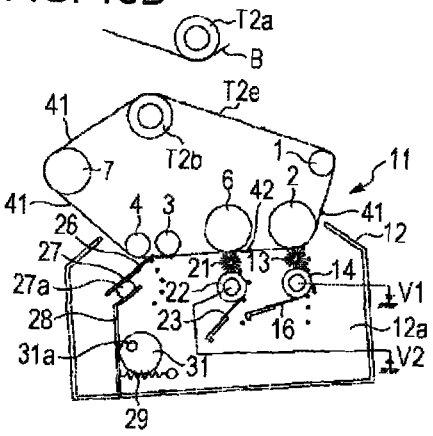
Figure 16E:
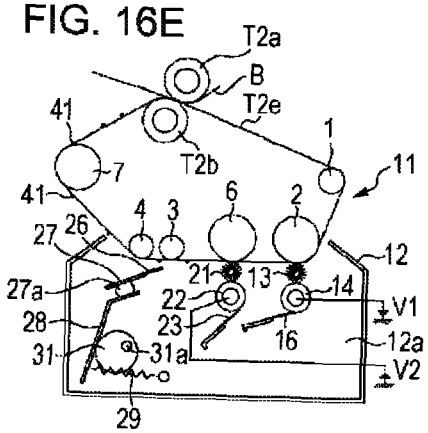
Figure 16C:
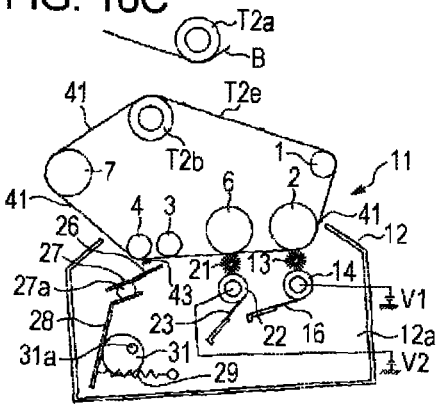

FIGS. 16A to 16E are diagrams for explaining the operation of the cleaner 11 according to the third exemplary embodiment. FIG. 16A illustrates a state in which an image is being formed. FIG. 16B illustrates a state in which the scraper 26 is in contact with the transport belt T2*e* and the transport belt T2*e* is separated from the intermediate transfer belt B. FIG. 16C illustrates a state in which the scraper 26 is separated from the transport belt T2*e* and the toner aggregate 43 has started to move downstream. FIG. 16D illustrates a state in which the toner aggregate 43 has been removed. FIG. 16E illustrates a state in which the transport belt T2*e* is in contact with the intermediate transfer belt B.

In the cleaner 11 according to the third exemplary embodiment having the above-described structure, in the image forming operation, the scraper 26 is retained at the position where the scraper 26 is separated from the transport belt T2*e*, as illustrated in FIG. 16A. Therefore, the transport belt T2*e* is cleaned by the brush rollers 13 and 21.

When the transport belt T2*e* is cleaned by using the scraper 26, the scraper 26 is brought into contact with the transport belt T2*e* and the transport belt T2*e* is separated from the intermediate transfer belt B, as illustrated in FIG. 16B. Accordingly, the surface of the transport belt T2*e* is cleaned by the scraper 26. Although the process of bringing the scraper 26 into contact with the transport belt T2*e* and the process of separating the transport belt T2*e* from the intermediate transfer belt B are simultaneously performed in the third exemplary embodiment, these processes may instead be performed at different times.

After the cleaning of the transport belt T2*e* by the scraper 26 is finished, the scraper 26 is separated from the transport belt T2*e*, as illustrated in FIG. 16C. Accordingly, the toner aggregate 43 is transported downstream as the transport belt T2*e* rotates.

In the third exemplary embodiment, the transport belt T2*e* is separated from the intermediate transfer belt B while the transport belt T2*e* rotates one turn. Therefore, the toner aggregate 43 passes through the gap between the transport belt T2*e* and the intermediate transfer belt B. Then, as illustrated in FIG. 16D, the toner aggregate 43 is removed by the upstream brush roller 13. Thus, in the third exemplary embodiment, the upstream brush roller 13 functions as a second cleaning member.

Subsequently, the process of ST22 is performed, so that the transport belt T2*e* is brought into contact with the intermediate transfer belt B, as illustrated in FIG. 16E.

According to the cleaner 11 of the third exemplary embodiment, the toner aggregate 43 is removed by the upstream brush roller 13, which serves as a second cleaning member, before the transport belt T2*e* comes into contact with the intermediate transfer belt B. Thus, the toner aggregate 43 is prevented from entering the second transfer region Q4 and forming a toner film.

Similar to the first and second exemplary embodiments, according to the cleaner 11 of the third exemplary embodiment, the life of the transport belt T2*e* may be increased and generation of the toner films from the toner aggregate 43 may be suppressed.

Modifications

Although exemplary embodiments of the present invention are described in detail above, the present invention is not limited to the above-described exemplary embodiments, and various modifications are possible within the scope of the present invention defined by the claims. Modifications (H01) to (H011) of the present invention will now be described.

(H01) Although the printer U is described as an example of an image forming apparatus in the exemplary embodiments, the image forming apparatus is not limited to this, and may instead be, for example, a copy machine, a facsimile machine, or a multifunction machine having some or all of the functions of these machines.

(H02) Although the printer U uses developers of four colors in the exemplary embodiments, the image forming apparatus is not limited to this, and may instead use developers of three or less colors or five or more colors.

(H03) The numerical values and parameters mentioned in the exemplary embodiments may be changed in accordance with, for example, the design or specification. For example, although the standby times t2 and t3 are set to the time in which the transport belt T2*e* rotates one turn in the second and third exemplary embodiments, the standby times t2 and t3 are not limited to this. Although the standby times t2 and t3 may be set to a time corresponding to one or more turns, they may instead be set to a time corresponding to less than one turn in accordance with the positions of the scraper 26 and the brush rollers 13 and 21 as long as the preliminary cleaning or the removal of the toner aggregate 43 may be reliably achieved by the brush rollers 13 and 21.

(H04) The mechanism for separating the belt unit 51 from the intermediate transfer belt B according to the third exemplary embodiment may be incorporated in the structures of the first and second exemplary embodiments. Specifically, the transport belt T2*e* may be separated from the intermediate transfer belt B when the cleaning process using the scraper 26 is started.

(H05) Although the endless band-shaped transport belt T2*e* is explained as an example of a rotating member in the exemplary embodiments, the rotating member is not limited to this. The cleaner may be used to clean an arbitrary rotating member formed in a drum shape, a roll shape, etc., instead of the belt shape.

(H06) Although two brush rollers 13 and 21 are provided to remove both the positively and negatively charged attached substances in the exemplary embodiments, the number of brush rollers is not limited to this, and may instead be one.

(H07) Although the cleaner 11 of the transport belt T2*e* is explained as an example of a cleaning device in the exemplary embodiments, the cleaning device is not limited to this, and may instead be a cleaner for cleaning the intermediate transfer belt B or the photoconductors Py to Pk.

(H08) Although the thin plate-shaped scraper 26 is explained as an example of a first cleaning member and the brush rollers 13 and 21 are explained as an example of second cleaning members in the exemplary embodiments, the combination of the first and second cleaning members is not limited to this. For example, a web, which is a band-shaped cloth, may be used in place of the brush rollers 13 and 21 and a resin blade made of rubber or the like may be used in place of the scraper 26.

(H09) Although the mechanisms for moving the scraper 26 and the belt unit 51 include a spring and a cam in the exemplary embodiments, the mechanisms are not limited to this. Other mechanisms such as a solenoid, a motor, a gear, a pinion, a rack, and a sliding mechanism may instead be used as long as the scraper 26 and the belt unit 51 may be moved.

(H010) Although the brush rollers 13 and 21 are respectively provided with the cleaning rollers 14 and 22 and the scrapers 16 and 23 in the exemplary embodiments, the brush rollers 13 and 21 may instead be provided with, for example, so-called flickers which are resilient against bristles.

(H011) Although voltages are applied to the cleaning rollers 14 and 22 in the exemplary embodiments, the voltages may instead be applied to, for example, the brush rollers 13 and 21.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device comprising:

a first cleaning member configured to contact a surface of a rotating member to clean the rotating member by removing substances attached to the rotating member, the rotating member being configured to contact with an image carrier configured to carry an image on a surface thereof;

a moving member that supports the first cleaning member such that the first cleaning member is movable toward and away from the surface of the rotating member; and a second cleaning member that is disposed downstream of the first cleaning member in a rotation direction in which the rotating member rotates and that contacts the surface of the rotating member to clean the rotating member by removing the substances attached to the rotating member, the second cleaning member being configured to remove the attached substances that remain on the surface of the rotating member after the first cleaning member has been separated from the rotating member so that the attached substances are removed before a part of the surface of the rotating member on which the attached substances remain comes into contact with the image carrier, wherein the first cleaning member is supported such that a tip end portion of the first cleaning member is capable of coming into contact with the surface of the rotating member at a position between two opposing rollers without any opposing rollers supporting the surface of the rotating member at the position between the two opposing rollers.

2. The cleaning device according to claim 1, wherein the first cleaning member is formed of a plate-shaped member, and the second cleaning member is formed of a brush-shaped member having a plurality of bristles.

3. An image forming apparatus comprising:

an image carrier configured to carry an image on a surface thereof;

a rotating member that faces the image carrier and configured to contact with the image carrier; and the cleaning device according to claim 1 that cleans the rotating member by removing substances attached to a surface of the rotating member.

4. A cleaning device comprising:

a first cleaning member configured to contact a surface of a rotating member to clean the rotating member by removing substances attached to the rotating member, the rotating member being configured to contact with an image carrier configured to carry an image on a surface thereof;

a moving member that supports the first cleaning member such that the first cleaning member is movable toward and away from the surface of the rotating member; and a second cleaning member that is disposed downstream of the first cleaning member and upstream of a position at which the rotating member is configured to contact with the image carrier in a rotation direction in which the rotating member rotates and that contacts the surface of the rotating member to clean the rotating member by removing the substances attached to the rotating member, wherein the first cleaning member is supported such that a tip end portion of the first cleaning member is capable of coming into contact with the surface of the rotating member at a position between two opposing rollers without any opposing rollers supporting the surface of the rotating member at the position between the two opposing rollers.

5. The cleaning device according to claim 4, further comprising:

a third cleaning member that is disposed upstream of the first cleaning member and downstream of the position at which the rotating member is configured to contact with the image carrier in the rotation direction in which the rotating member rotates and that contacts the surface of the rotating member to clean the rotating member by removing the substances attached to the rotating member.

6. The cleaning device according to claim 5, wherein the first cleaning member is formed of a plate-shaped member, and the second cleaning member is formed of a brush-shaped member having a plurality of bristles.

7. The cleaning device according to claim 4, wherein the first cleaning member is formed of a plate-shaped member, and the second cleaning member is formed of a brush-shaped member having a plurality of bristles.

8. A cleaning device comprising:

a first cleaning member configured to contact a surface of a rotating member to clean the rotating member by removing substances attached to the rotating member, the rotating member being supported so as to be capable of being in contact with and separated from an image carrier configured to carry an image on a surface thereof;

a moving member that supports the first cleaning member such that the first cleaning member is movable toward and away from the surface of the rotating member; and a second cleaning member that is disposed upstream of the first cleaning member and downstream of a position at which the rotating member contacts the image carrier in a rotation direction in which the rotating member rotates, wherein the second cleaning member is configured to contact the surface of the rotating member that has passed through a position at which the rotating member faces the image carrier while the rotating member has been separated from the image carrier, so that the second cleaning member cleans the rotating member by removing the substances attached to the rotating member before the surface of the rotating member comes into contact with the surface of the image carrier, wherein the first cleaning member is supported such that a tip end portion of the first cleaning member is capable of coming into contact with the surface of the rotating member at a position between two opposing rollers without any opposing rollers supporting the surface of the rotating member at the position between the two opposing rollers.

9. The cleaning device according to claim 8, wherein the first cleaning member is formed of a plate-shaped member, and the second cleaning member is formed of a brush-shaped member having a plurality of bristles.

* * * * *